United States Patent [19]

Shirai et al.

[11] Patent Number: 4,547,448

[45] Date of Patent: Oct. 15, 1985

[54] PHOTOCONDUCTIVE MEMBER COMPRISING SILICON AND OXYGEN

[75] Inventors: Shigeru Shirai, Yamato; Kyosuke Ogawa, Sakurashin; Junichiro Kanbe, Yokohama; Keishi Saitoh, Tokyo; Yoichi Osato, Yokohama; Teruo Misumi, Kawasaki, all of Japan

[73] Assignee: Canon Kabushiki Kaisha, Tokyo, Japan

[21] Appl. No.: 627,499

[22] Filed: Jul. 6, 1984

Related U.S. Application Data

[63] Continuation of Ser. No. 470,599, Feb. 28, 1983, abandoned.

[30] Foreign Application Priority Data

Mar. 4, 1982 [JP] Japan ..... 57-34210
Mar. 5, 1982 [JP] Japan ..... 57-35633
Mar. 5, 1982 [JP] Japan ..... 57-35634

[51] Int. Cl.[4] ..... G03G 5/082

[52] U.S. Cl. ..... 430/84; 430/57; 430/95

[58] Field of Search ..... 430/65, 66, 84, 95, 430/58, 57

[56] References Cited

U.S. PATENT DOCUMENTS 4,359,512 11/1982 Fukuda et al. ..... 430/58
4,361,638 11/1982 Higashi et al. ..... 430/66
4,409,308 10/1983 Shimizu et al. ..... 430/84
4,414,319 11/1983 Shirai et al. ..... 430/66

*Primary Examiner*—John L. Goodrow
*Attorney, Agent, or Firm*—Fitzpatrick, Cella Harper & Scinto

[57] ABSTRACT

A photoconductive member comprises a support for a photoconductive member; a first amorphous layer comprising an amorphous material containing silicon atoms as a matrix and exhibiting photoconductivity, said first amorphous layer having a first layer region containing oxygen atoms as constituent atoms in a distribution state which is ununiform and continuous in the direction of layer thickness and a second layer region containing atoms belonging to the group III of the periodic table as constituent atoms in a distribution state which is continuous in the direction of layer thickness, said first layer region existing internally beneath the surface of said first amorphous layer; and a second amorphous layer comprising an amorphous material represented by any of the following formulae:

$$Si_aC_{1-a}(0.4<a<1) \quad (1)$$

$$(Si_bC_{1-b})_cH_{1-c}(0.5<b<1,\ 0.6\leqq c<1) \quad (2)$$

$$(Si_dC_{1-d})_eX_{1-e}(0.47<d<1,\ 0.8\leqq e<1) \quad (3)$$

$$(Si_fC_{1-f})_g(H+X)_{1-g}(0.47<f<1,\ 0.8\leqq g<1) \quad (4)$$

(wherein X represents a halogen atom).

22 Claims, 11 Drawing Figures

PHOTOCONDUCTIVE MEMBER COMPRISING SILICON AND OXYGEN

This application is a continuation of application Ser. No. 470,599 filed Feb. 28, 1983, now abandoned.

BACKGROUND OF THE INVENTION

1. Field of the Invention

This invention relates to a photoconductive member having sensitivity to electromagnetic waves such as light [herein used in a broad sense, including ultraviolet rays, visible light, infrared rays, X-rays and gamma rays].

2. Description of the Prior Arts

Photoconductive materials, which constitute photoconductive layers in solid state image pick-up devices, image forming members for electrophotography in the field of image formation, or manuscript reading devices, are required to have a high sensitivity, a high SN ratio [Photocurrent ($I_p$)/Dark current ($I_d$)], spectral characteristics matching to those of electromagnetic waves to be irradiated, a rapid response to light, a desired dark resistance value as well as no harm to human bodies during use. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon [hereinafter referred to as a-Si] has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in an electro-photoconverting reading device.

However, under the present situation, the conventional photoconductive members having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with lapse of time.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated use or so called ghost phenomenon wherein residual images are formed.

As another disadvantage, for example, according to the experience by the present inventors from a number of experiments, a-Si material constituting the photoconductive layer of an image forming member for electrophotography, while it has a number of advantages as compared with inorganic photoconductive materials such as Se, CdS, ZnO or organic photoconductive materials such as PVCz or TNF of piror art, is also found to have several probelms to be solved. Namely, when charging treatment for formation of electrostatic images is applied on the photoconductive layer of an image forming member for electrophotography with the photoconductive member being constituted of a monolayer of a-Si which has been endowed with characteristics for use in a solar battery of prior art, dark decay is markedly rapid, whereby it is difficult to apply a usual electrophotographic method. This tendency is further pronounced under a humid atmosphere to such an extent in some cases that no charge is retained at all until development.

Further, when the photoconductive layer is constituted of a-Si materials, the photoconductive layer may contain as constituent atoms hydrogen atoms or halogen atoms such as fluorine atoms, chlorine atoms, etc. for improving their electrical, photoconductive characteristics, and boron atoms, phosphorus atoms, etc. for controlling the electroconduction type as well as other atoms for improving other characteristics. Depending on the manner in which these constituent atoms are contained, there may sometimes be caused problems with respect to electrical, optical or photoconductive characteristics of the layer formed.

That is, for example, not scarcely the life of the photocarriers generated by light irradiation in the photoconductive layer formed is insufficient, or at the dark portion, the charges injected from the support side cannot sufficiently be impeded.

Thus, it is required in designing of a photoconductive member to make efforts to obtain desirable electrical, optical and photoconductive characteristics as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. Now, a photoconductive member having a photoconductive layer which comprises a-Si, particularly an amorphous material containing at least one of hydrogen atom (H) and halogen atom (X) in a matrix of silicon atoms [hereinafter referred to comprehensively as a-Si(H,X)], so called hydrogenated amorphous silicon, halogenated amorphous silicon or halogen-containing hydrogenated amorphous silicon, said photoconductive member being prepared by designing so as to have a specific structure, is found to exhibit not only practically extremely excellent characteristics but also surpass the photoconductive members of the prior art in substantially all respects, especially markedly excellent characteristics as a photoconductive member for electrophotography. The present invention is based on such finding.

SUMMARY OF THE INVENTION

The object of the present invention is to provide an all-environment type photoconductive member whose electrical, optical and photoconductive characteristics are constantly stable without being influenced by use environment, and which is markedly excellent in light fatigue resistance and also excellent in durability without causing any deterioration phenomenon after repeated use and free entirely or substantially from residual potentials observed.

Another object of the present invention is to provide a photoconductive member having excellent electrophotography characteristics, which is sufficiently capable of retaining charges at the time of charging treatment for formation of electrostatic images to the extent such that a usual electrophotographic method can be very effectively applied when it is provided for use as an image forming member for electrophotography.

A further object of the present invention is to provide a photoconductive member for electrophotography capable of providing easily a high quality image which is high in density, clear in halftone and high in resolution.

Still another object of the present invention is to provide a photoconductive member having high photosensitivity, high SN ratio characteristic and good electrical contact with a support.

According to the present invention, there is provided a photoconductive member comprising a support for a photoconductive member; and a first amorphous layer comprising an amorphous material containing silicon atoms as a matrix and exhibiting photoconductivity, said first amorphous layer having a first layer region containing oxygen atoms as constituent atoms in a distribution state which is ununiform and continuous in the direction of layer thickness and a second layer region containing atoms belonging to the group III of the periodic table as constituent atoms in a distribution state which is continuous in the direction of layer thickness, said first layer region existing, internally beneath the surface of said first amorphous layer; and a second amorphous layer comprising an amorphous material represented by any of the following formulae:

$$Si_aC_{1-a}\ (0.4<a<1) \quad (1)$$

$$(Si_bC_{1-b})_cH_{1-c}\ (0.5<b<1,\ 0.6\leqq c<1) \quad (2)$$

$$(Si_dC_{1-d})_eX_{1-e}\ (0.47<d<1,\ 0.8\leqq e<1) \quad (3)$$

$$(Si_fC_{1-f})_g(H+X)_{1-g}\ (0.47<f<1,\ 0.8\leqq g<1) \quad (4)$$

(wherein X represents a halogen atom) [the amorphous materials represented by the formulae (1)-(4) are hereinafter abbreviated as a-SiC, a-SiCH, a-SiCX and a-SiC(H+X)].

DETAILED DESCRIPTION OF THE PREFERRED EMBODIMENTS

Figure 1:
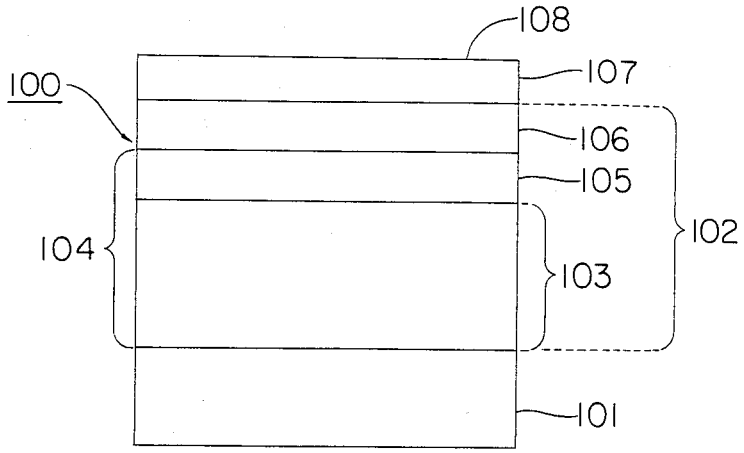
FIG. 1 is a schematic sectional view for illustration of the layer constitution of a preferred embodiment of the photoconductive member according to the present invention.

Referring now to the drawing, the photoconductive members according to the present invention are to be described in detail below.

FIG. 1 shows a schematic sectional view for illustration of a typical exemplary constitution of the photoconductive member of this invention.

The photoconductive member 100 as shown in FIG. 1 has a support 101 for photoconductive member, a first amorphous layer (I) 102 exhibiting photoconductivity comprising a-Si, preferably a-Si(H,X) and a second amorphous layer (II) 107 provided on the support.

The first amorphous layer (I) 102 has a layer structure constituted of a first layer region (O) 103 containing oxygen atoms as constituent atoms, a second layer region (III) 104 containing atoms of an element belonging to the group III of the periodic table (the group III atoms) as constituent atoms and a layer region 106 containing neither oxygen atoms nor the group III atoms on the second layer region (III) 104.

In a layer region 105 provided between the first layer region (O) 103 and the layer region 106, the group III atoms are contained but no oxygen atom is contained.

The oxygen atoms contained in the first layer region (O) 103 are distributed in said layer region 103 continuously in the direction of the layer thickness in a state of ununiform distribution, but in the direction substantially parallel to the surface of the support 101, they are preferably distributed continuously and substantially uniformly.

In the photoconductive member of the present invention, as shown in FIG. 1, it is necessary to provide a layer region containing no oxygen atom (corresponding to the layer region 106 in FIG. 1) at the surface portion of the first amorphous layer (I) 102, but it is not necessarily required to provide a layer region containing the group III atoms but containing no oxygen atom (corresponding to the layer region 105 shown in FIG. 1).

That is, for example, the first layer region (O) may be the same layer region as the second layer region (III), or alternatively the second layer region (III) may be provided within the first layer region (O).

The group III atoms to be contained in the second layer region (III) are distributed in said layer region (III) continuously in the direction of layer thickness, and the distribution state may be either ununiform or substantially uniform. However, in the direction substantially parallel to the surface of the support 101, they are preferably distributed continuously and substantially uniformly.

In the photoconductive member 100 as shown in FIG. 1, the layer region 106 contains no atom of the group III, but said layer region 106 may also contain the group III atoms in the present invention.

In the photoconductive member according to the present invention, improvements to higher dark resistance and to better adhesion between the first amorphous layer (I) and the support on which it is directly provided are intended preponderantly by incorporation of oxygen atoms in the first layer region (O).

In particular, better results may be obtained in case of layer structures, where as the photoconductive member 100 shown in FIG. 1 the first amorphous layer (I) 102 has a first layer region (O) 103 containing oxygen atoms, a second layer region (III) 104 containing the group III atoms, a layer region 105 containing no oxygen atom and a layer region 106 containing none of oxygen atoms and the group III atoms, said first layer region (O) 103 and said second layer region (III) 104 sharing a common layer region.

Also, in the photoconductive member of the present invention, the distribution of oxygen atoms contained in the first layer region (O) is made in the first place in the direction of its layer thickness so as to be more enriched toward the support side or the bonded interface side with another layer for improvement of adhesion to or contact with the support on which said first layer region (O) is provided or another layer. Secondly, the oxygen atoms contained in the above first layer region (O), in order to make the electrical contact smooth at the bonded interface with the layer region containing no oxygen atom provided on the first layer region (O), may preferably be contained in the first layer region (O) so that its depth profile may be gradually decreased toward the side of the layer region containing no oxygen atom and the depth profile of oxygen atoms may be substantially zero at the bonded interface.

The same is the case with respect to the group III atoms in the second layer region (III). That is, in case of the example where no group III atom is contained in the layer region on the surface side of the first amorphous layer (I), the depth profile of the group III atoms in the second layer region (III) may preferably be formed so that said depth profile on said surface layer region side is gradually decreased in the direction toward the bonded interface with the layer region on said surface side and is substantially zero at said bonded interface.

In the present invention, the atoms belonging to the group III of the periodic table to be incorporated in the second layer region (III) constituting the first amorphous layer (I) may include B (boron), Al (aluminum), Ga (gallium), In (indium), Tl (thallium) and the like. Among them, B and Ga are particularly preferred.

In the present invention, the content of the group III atoms in the second layer region (III), which may be suitably determined as desired so as to achieve effectively the object of the present invention, may be preferably 0.01 to 1000 atomic ppm, more preferably 0.5 to 800 atomic ppm, most preferably 1 to 500 atomic ppm. The content of oxygen atoms in the first layer region (O) may also be determined suitably depending on the characteristics required for the photoconductive member formed, but preferably 0.001 to 20 atomic %, more preferably 0.002 to 10 atomic %, most preferably 0.003 to 5 atomic %.

FIGS. 2 through 10 show typical examples of the distribution in the direction of layer thickness, of oxygen atoms and the group III atoms contained in the first amorphous layer (I) of the photoconductive member according to the present invention.

In FIGS. 2 through 10, the axis of abscissa indicates the content C of oxygen atoms or the group III atoms and the axis of ordinate the direction of the layer thickness of the first amorphous layer (I) exhibiting photoconductivity, $t_B$ showing the position of the surface of the first amorphous layer (I) on the support side and $t_s$ the position of the surface of the first amorphous layer (I) on the side opposite to the support side. That is, the growth of the first amorphous layer (I) containing oxygen atoms and the group III atoms proceeds from the $t_B$ side toward the $t_s$ side.

The scale of the axis of abscissa for oxygen atoms is different from that for the group III atoms. The solid lines A2–A10 represent depth profile lines of oxygen atoms and the solid lines B2–B10 those of the group III atoms, respectively.

Figure 2:
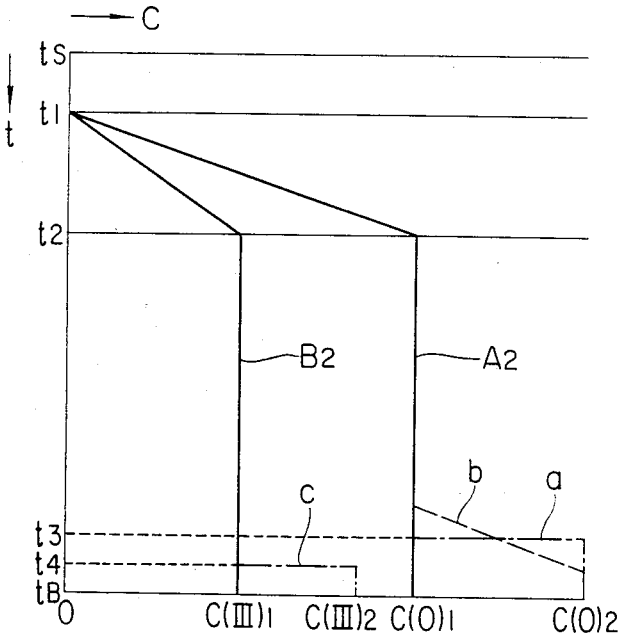
FIGS. 2 through 10 schematic sectional views for illustration of the layer constitutions of the amorphous layer (I) constituting the photoconductive member of the present invention, respectively.

In FIG. 2, there is shown a first typical embodiment of the distribution of oxygen atoms and the group III atoms contained in the first amorphous layer (I) in the direction of the layer thickness.

According to the embodiment as shown in FIG. 2, the amorphous layer (I) ($t_s$ $t_B$) (the whole layer region from $t_s$ to $t_B$) comprising a-Si(H,X) and exhibiting photoconductivity has from the support side, a layer region ($t_2$ $t_B$) (the layer region between $t_2$ and $t_B$) wherein oxygen atoms and group III atoms are distributed, respectively, at concentrations of $C_{(O)1}$ and $C_{(III)1}$ substantially uniformly in the layer thickness direction, a layer region ($t_1$ $t_2$) wherein oxygen atoms are gradually decreased linearly in the depth profile from $C_{(O)1}$ to substantially zero and the group III atoms decreased linearly in the depth profile from $C_{(III)1}$ to substantially zero, and a layer region ($t_s$ $t_1$) wherein oxygen atoms and the group III atoms are not contained substantially.

In case of the embodiment as shown in FIG. 2, where the first amorphous layer (I) ($t_s$ $t_B$) has a contact interface with the support or another layer (corresponding to $t_B$) and a layer region ($t_2$ $t_B$) with oxygen atoms and the group III atoms being uniformly distributed, the concentrations $C_{(III)1}$ and $C_{(O)1}$, which may suitably be determined as desired in relation to the support or another layer, are preferably 0.1 to 10000 atomic ppm, more preferably 1 to 4000 atomic ppm, most preferably 2 to 2000 atomic ppm, based on silicon atoms, for $C_{(III)1}$; and preferably 0.01 to 30 atomic %, more preferably 0.02 to 20 atomic %, most preferably 0.03 to 10 atomic %, based on silicon atoms, for $C_{(O)1}$. The layer region ($t_1$ $t_2$) is provided primarily for the purpose of making electrical contact between the layer region ($t_s$ $t_1$) and the layer region ($t_2$ $t_B$) smooth, and the layer thickness of said layer region ($t_1$ $t_2$) should be determined suitably as desired in relation to the distribution concentration $C_{(O)1}$ of oxygen atoms and the distirbution concentration $C_{(III)1}$ of the group III atoms, especially the distribution concentration $C_{(O)1}$.

The layer region ($t_s$ $t_1$), which may optionally contain the group III atoms but contain none of oxygen atoms, may have a thickness suitably determined as desired so that the photoconductive member obtained may have sufficinet dielectric strength against repeated use, or when photocarriers are to be generated in said layer region ($t_s$ $t_1$) by irradiation of light, so that the irradiated light may be sufficiently absorbed in said layer region ($t_s$ $t_1$).

From such a point of view, in the present invention, the layer region containing none of oxygen atoms formed as an end layer region of the first amorphous layer (I) at the side of the second amorphous layer (II) is desired to have a thickness preferably of 100 Å to 10μ, more preferably 200 Å to 5μ, most preferably 500 Å to 3μ.

In a photoconductive member having depth profiles of oxygen atoms and the group III atoms as shown in FIG. 2, for improvement of adhesion with the support or another layer as well as inhibition of charges from being injected from the support side to the first amorphous layer (I), while also aiming at improvement to higher photosensitivity and higher dark resistance, it is preferable to provide a layer region ($t_3$ $t_B$) which is made higher in concentration of oxygen atoms than the concentration $C_{(O)1}$ at the portion on the support side surface (corresponding to the position $t_B$) in the first amorphous layer (I) as shown by the borken line a in FIG. 2.

The concentration $C_{(O)2}$ of oxygen atoms in the layer region ($t_3$ $t_B$) where oxygen atoms are distributed at a higher concentration may be generally 30 atomic % or more, preferably 40 atomic % or more, most preferably 50 atomic % or more, based on silicon atoms. The depth profile of oxygen atoms in the layer region ($t_3$ $t_B$) where oxygen atoms are distributed at higher concentration may be made constant (uniform) in the layer thickness direction as shown by the broken line a in FIG. 2, or alternatively in order to make good electrical contact with adjacent layer region directly bonded, it may be made a constant value of $C_{(O)2}$ from the support side to a certain thickness and thereafter gradually decreased continuously to $C_{(O)1}$.

The depth profile of the group III atoms contained in the second layer region (III) may be preferably made so as to give a layer region maintaining a constant value of the concentration $C_{(III)1}$ [corresponding to the layer region ($t_2$ $t_B$)] on the support side, but it is more preferable for the purpose of inhibiting efficiently injection of charges from the support side to the amorphous layer (I) to provide a layer region ($t_4$ $t_B$) in which the group III atoms are distributed at a higher concentration as shown by the broken line c in FIG. 2. on the support side.

In the present invention, the layer region ($t_4$ $t_B$) may be preferably provided within 5μ from the position $t_B$. The layer region ($t_4$ $t_B$) may be made the whole layer region ($L_T$) to the thickness of 5μ from the position $t_B$, or may be provided as a part of the layer region ($L_T$).

It may be suitably determined depending on the characteristics required for the amorphous layer (I) formed, whether the layer region ($t_4$ $t_B$) should be made a part or whole of the layer region ($L_T$).

The layer region ($t_4$ $t_B$) may be desirably formed so that the group III atoms may be distributed in the layer thickness direction with the maximum content distribution value (distribution concentration value) $C_{max}$ being preferably 50 atomic ppm or more, more preferably 80 atomic ppm or more, most preferably 100 atomic ppm or more, based on silicon atoms.

That is, in the present invention, the second layer region (III) containing the group III atoms may preferably be formed so that the maximum value $C_{max}$ of the content distribution may exist at a depth within 5μ of layer thickness from the support side (layer region of 5μ thickness from $t_B$).

In the present invention, the layer region ($t_3$ $t_B$) where oxygen atoms are distributed at higher concentration and the layer region ($t_4$ $t_B$) where the group III atoms are distributed at higher concentration may have thicknesses, which may suitably be determined depending on the contents and the distribution states of oxygen atoms or the group III atoms, may be desired to be preferably 30 Å to 5μ, more preferably 40 Å to 4μ, most preferably 50 Å to 3μ.

Figure 3:
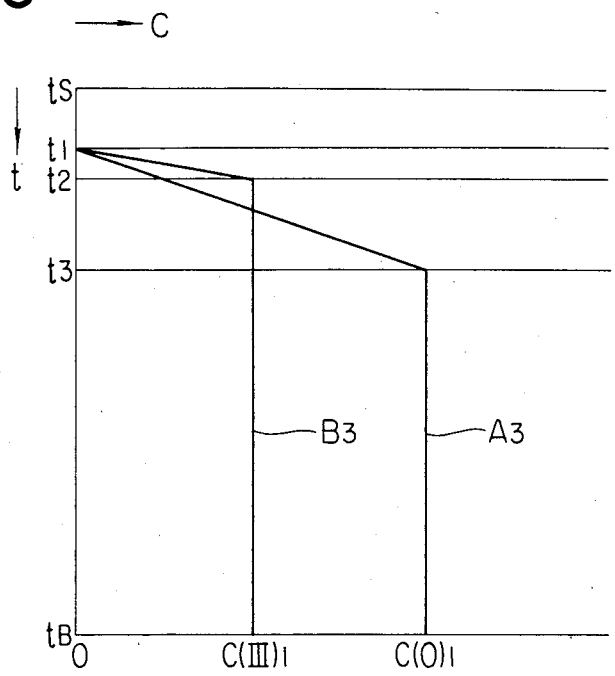

The embodiment shown in FIG. 3 is basically similar to that shown in FIG. 2, but differs in the following point. That is, in the embodiment shown in FIG. 2, both of the depth profiles of oxygen atoms and of the group III atoms commence to be decreased at the position $t_2$ until they become substantially zero at the position $t_1$. In contrast, in case of the embodiment in FIG. 3, the depth profile of oxygen atoms begins to be decreased at the position $t_3$, as shown by the solid line A3, while the depth profile of the group III atoms begins to be decreased at the position $t_2$, as shown by the solid line B3, respectively, both becoming substantially zero at the position $t_1$.

That is, the first layer region (O) ($t_1$ $t_B$) containing oxygen atoms is constituted of a layer region ($t_3$ $t_B$) in which they are contained substantially uniformly at a concentration of $C_{(O)1}$ and a layer region ($t_1$ $t_3$) in which the concentration is decreased linearly from $C_{(O)1}$ to substantially zero.

The second layer region (III) ($t_1$ $t_B$) containing the group III atoms is constituted of a layer region ($t_2$ $t_B$) in which they are contained substantially uniformly at a concentration of $C_{(III)1}$ and a layer region ($t_1$ $t_2$) in which the concentration is decreased linearly from $C_{(III)1}$ at the position $t_2$ to substantially zero.

Figure 4:
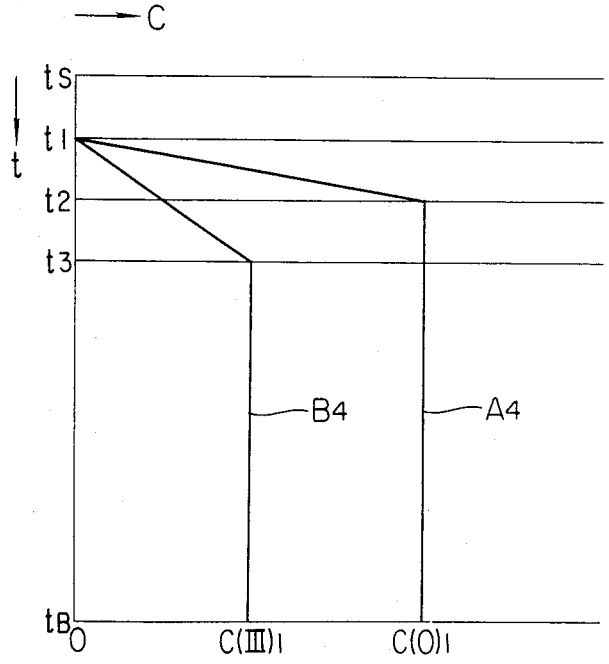

The embodiment shown in FIG. 4 is a modification of the embodiment shown in FIG. 3, having the same constitution as in FIG. 3 except that there is provided a layer region ($t_3$ $t_B$) where the group III atoms are contained in a uniform distribution at a concentration of $C_{(III)1}$ within a layer region ($t_2$ $t_B$) where oxygen atoms are distributed uniformly at a concentration of $C_{(O)1}$.

Figure 5:
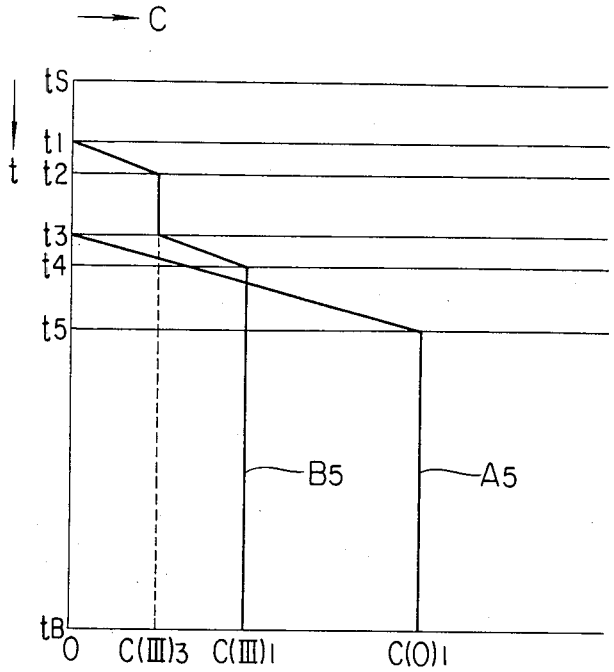

FIG. 5 shows an embodiment, having two layer regions containing the group III atoms uniformly distributed at a certain concentration.

The amorphous layer (I) shown in FIG. 5 is constituted, from the side of the support, a layer region ($t_3$ $t_B$) containing both oxygen and the group III atoms, a layer region ($t_1$ $t_3$) containing the group III atoms but no oxygen atom on said layer region ($t_3$ $t_B$) and a layer region ($t_s$ $t_1$) containing none of the group III atoms and oxygen atoms.

And, the layer region (O) ($t_3$ $t_B$) containing oxygen atoms is constituted of a layer region ($t_5$ $t_B$) in which they are distributed substantially uniformly at a concentration of $C_{(O)1}$ in the layer thickness direction and a layer region ($t_3$ $t_5$) in which they are gradually decreased linearly from the concentration $C_{(O)1}$ to substantially zero.

The layer region ($t_1$ $t_B$) has a laminated layer structure comprising, from the side of the support, a layer region ($t_4$ $t_B$) in which the group III atoms are distributed substantially uniformly at a concentration of $C_{(III)1}$ in the layer thickness direction, a layer region ($t_3$ $t_4$) in which they are continuously decreased linearly from the concentration $C_{(III)1}$ to the concentration $C_{(III)3}$, a layer region ($t_2$ $t_3$) in which they are distributed substantially uniformly at a distribution concentration of $C_{(III)3}$ in the layer thickness direction and a layer region ($t_1$ $t_2$) in which they are continuously decreased lineraly from the concentration $C_{(III)3}$.

Figure 6:
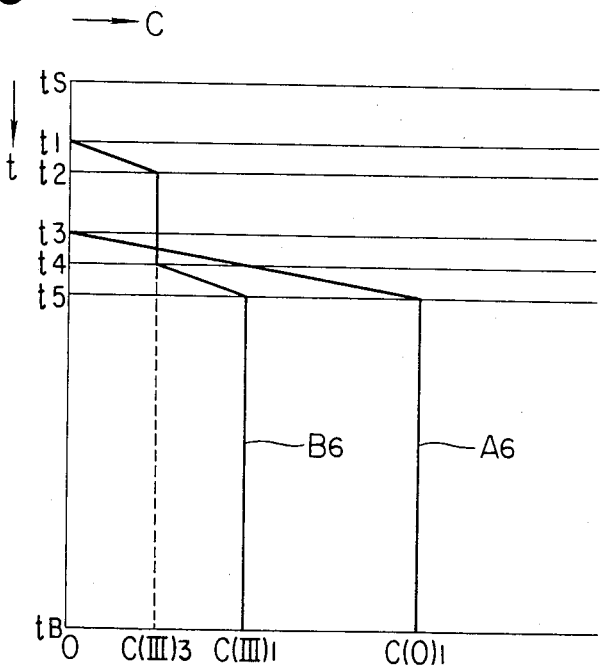

FIG. 6 shows a modification of the embodiment as shown in FIG. 5.

In case of the embodiment shown in FIG. 6, there are provided a layer region ($t_5$ $t_B$) in which oxygen atoms and the group III atoms are distributed uniformly at the concentrations of $C_{(O)1}$, $C_{(III)1}$, respectively, and a layer region ($t_3$ $t_5$) wherein oxygen atoms are gradually decreased from the concentration $C_{(O)1}$ linearly to substantially zero, and within the layer region ($t_3$ $t_5$), there are formed a layer region ($t_3$ $t_4$) in which the group III atoms are contained and distributed in a linearly decreasing state and a layer region ($t_3$ $t_4$) in which the group III atoms are contained in a substantially uniform distribution at the concentration of $C_{(III)3}$.

On the layer region ($t_3$ $t_B$), there is provided a layer region ($t_s$ $t_3$) containing substantially no oxygen atoms, which layer region ($t_s$ $t_3$) is constituted of a layer region ($t_1$ $t_3$) containing the group III atoms and a layer region ($t_s$ $t_1$) containing none of oxygen atoms and the group III atoms.

Figure 7:
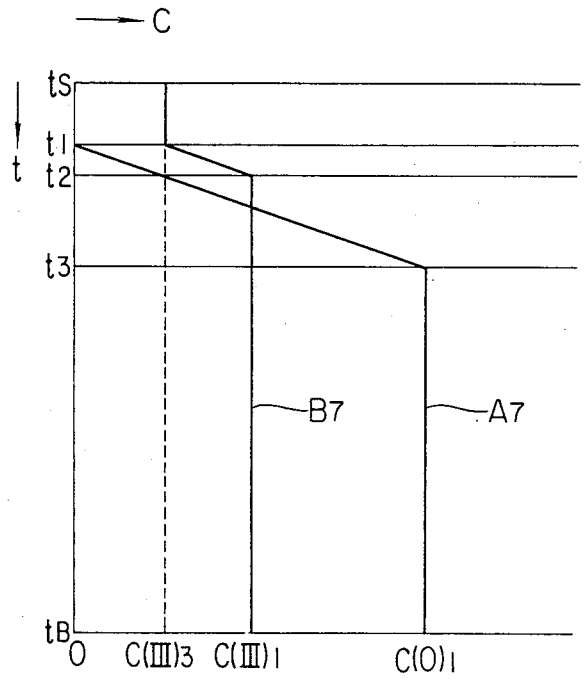

FIG. 7 shows an embodiment wherein the group III atoms are contained in the whole region of the amorphous layer [layer region ($t_s$ $t_B$)], and none of oxygen atoms are contained in the layer region ($t_s$ $t_1$) on the surface side.

The layer region ($t_1$ $t_B$) containing oxygen atoms, as shown by the solid line A7, has a layer region ($t_3$ $t_B$) in which they are contained substantially uniformly at a concentration of $C_{(O)1}$ and a layer region (O) ($t_1$ $t_3$) in which oxygen atoms are contained in a depth profile gradually decreasing from the distribution concentration $C_{(O)1}$ to substantially zero.

The depth profile of the group III atoms in the first amorphous layer (I) is shown by the solid line B7. That is, the layer region ($t_s$ $t_B$) containing the group III atoms has a layer region ($t_2$ $t_B$) in which they are contained substantially uniformly at a concentration of $C_{(III)3}$, a layer region ($t_1$ $t_2$) in which the group III atoms are contained in a depth profile which is continuously changed linearly between distribution concentrations $C_{(III)1}$ and $C_{(III)3}$, and a layer region ($t_s$ $t_1$) in which the group III atoms are distributed uniformly at a distribution concentration $C_{(III)3}$. The layer region ($t_1$ $t_2$) are formed between the layer regions ($t_2$ $t_B$) and ($t_s$ $t_1$) in order to change continuously the distribution of the group III atoms between the concentrations $C_{(III)1}$ and $C_{(III)3}$.

Figure 8:
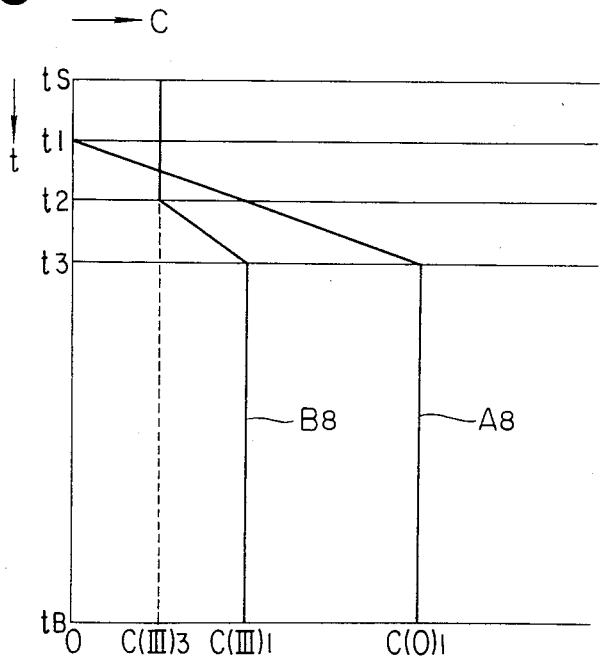

FIG. 8 shows a modification of the embodiment shown in FIG. 7.

Throughout the whole region of the first amorphous layer (I), the group III atoms are contained as shown by the solid line B8, and oxygen atoms in the layer region ($t_1$ $t_B$). In the layer region ($t_3$ $t_B$), oxygen atoms are contained at a concentration of $C_{(O)1}$ and the group III atoms at a concentration of $C_{(III)1}$, respectively in uniform distributions, while in the layer region ($t_s$ $t_2$) the group III atoms are distirubuted uniformly at a concentration of $C_{(III)3}$.

Oxygen atoms are contained, as shown by the solid line A8, in the layer region ($t_1$ $t_3$) in a depth profile gradually decreased gradually linearly from the distribution concentration $C_{(O)1}$ at the support side to substantially zero at the position $t_1$.

In the layer region ($t_2$ $t_3$), the group III atoms are contained in a depth profile gradually decreased from the concentration of $C_{(III)1}$ to the concentration $C_{(III)3}$.

Figure 9:
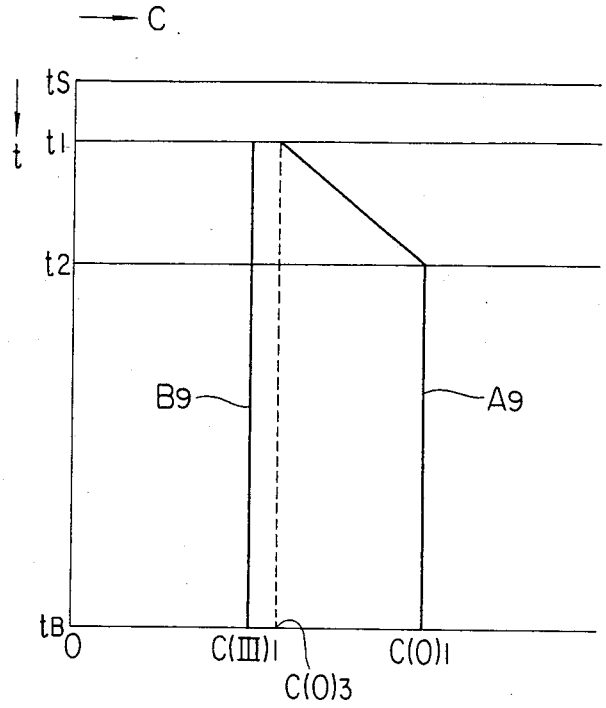
Figure 10:
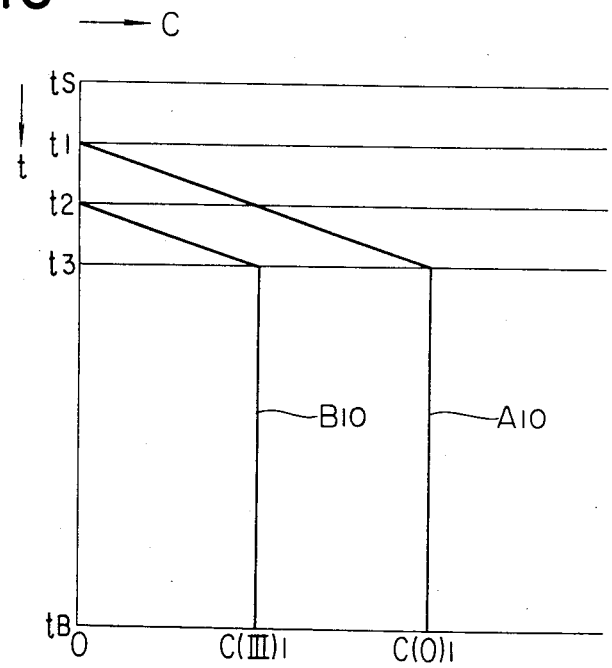

In FIG. 9, there is shown an embodiment in which in a layer region containing oxygen atoms ununiformly distributed and the group III atoms continuously distributed in the layer thickness direction, the group III atoms are distributed substantially uniformly in the layer direction.

In the embodiment as shown in FIG. 9, the first layer region (O) containing oxygen atoms and the second layer region (III) containing the group III atoms are substantially the same layer region, said embodiment having also a layer region containing none of oxygen atoms and the group III atoms on the surface side.

Oxygen atoms are distributed in substantially uniform distribution at a concentration of $C_{(O)1}$ in the layer region ($t_2$ $t_B$), and, in the layer region ($t_1$ $t_2$), oxygen atoms are continuously decreased from the concentration $C_{(O)1}$ to the concentration $C_{(O)3}$. In the embodiment shown in FIG. 10, there are provided a layer region (O) containing oxygen atoms continuously distributed and a layer region (III) containing the group III atoms also continuously distributed, both kinds of atoms being ununiformly distributed in the respective layer regions. The layer region (III) containing the group III atoms is provided within the layer region (O) containing oxygen atoms.

And, in the layer region ($t_3$ $t_B$), oxygen atoms are contained substantially uniformly at a constant concentration $C_{(O)1}$ and the group III atoms at a constant concentration $C_{(III)1}$, respectively, while in the layer region ($t_2$ $t_3$), oxygen atoms and the group III atoms are contained, decreasing gradually as the growth of the respective layers, until the distribution concentration of the group III atoms is substantially zero at $t_2$.

Oxygen atoms are contained even in the layer region ($t_1$ $t_2$) containing no group III atom so as to form a linearly decreased depth profile, until it is substantially zero at $t_1$.

In the layer region ($t_s$ $t_1$), none of oxygen atoms and the group III atoms are contained.

Having described about some typical examples of the depth profiles of oxygen atoms and the group III atoms in the layer thickness direction contained in the amorphous layer by referring to FIGS. 2 through 10, it is also possible in case of FIGS. 3 through 10 to provide a layer region with a distribution having a portion with higher concentration C of oxygen atoms or the group III atoms on the support side and a portion significantly lowered in the concentration C as compared with the support side on the surface $t_2$ side, similarly as described with reference to FIG. 2. The distribution concentration of oxygen atoms and the group III atoms may be decreased in respective layer regions not only linearly but also in a curve.

In the present invention, typical examples of halogen atoms (X) which may be optionally incorporated in the first amorphous layer (I) are fluorine, chlorine, bromine and iodine, especially preferably fluorine and chlorine.

In the present invention, formation of the first amorphous layer (I) comprising a-Si(H, X) may be conducted according to the vacuum deposition method utilizing discharging phenomenon, such as glow discharge method, sputtering method or ion-plating method. For example, for formation of the first amorphous layer (I) comprising a-Si (H, X) according to the glow discharge method, the basic procedure comprises introducing a starting gas for introduction of hydrogen atoms (H) and/or halogen atoms (X) together with a starting gas for supplying silicon atoms (Si) into the deposition chamber which can be internally brought to a reduced pressure, and exciting glow discharge in said deposition chamber, thereby forming a layer comprising a-Si(H,X) on the surface of a support set at a predetermined position. For formation of the layer according to the sputtering method, when effecting sputtering with a target constituted of Si in an atmosphere of, for example, an inert gas such as Ar, He, etc. or a gas mixture based on these gases, a gas for introduction of hydrogen atoms (H) and/or halogen atoms (X) may be introduced into the deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

Effective starting gases for introduction of halogen atoms to be used in the present invention may include a large number of gaseous or gasifiable halogen compounds, as exemplified by halogen gases, halides, interhalogen compounds, and silane derivatives substituted with halogens.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, and interhalogen compounds such as BrF, ClF, $ClF_3$, $BrF_5$, $BrF_3$, $IF_3$, $IF_7$, ICl, IBr, etc.

As silicon compounds containing halogen atoms (X), namely so called silane derivatives substituted with halogen atoms, there may preferably be employed silicon halides such as $SiF_4$, $Si_2F_6$, $SiCl_4$, $SiBr_4$ and the like.

When the characteristic photoconductive member of the present invention is to be formed according to the glow discharge method by employment of such a silicon compound containing halogen atoms, it is possible to form a first amorphous layer (I) constituted of a-Si containing halogen atoms on a certain support without use of a hydrogenated silicon gas as the starting material capable of supplying Si.

For formation of a first amorphous layer (I) containing halogen atoms according to the glow discharge method, the basic procedure comprises introducing a silicon halide gas as the starting gas for supplying silicon and a gas such as Ar, $H_2$, He, etc. at a predetermined mixing ratio and gas flow rates into a deposition chamber for formation of the first amorphous layer (I) and exciting glow discharging therein to form a plasma atmosphere of these gases, whereby the first amorphous layer (I) can be formed on a certain support. For the purpose of introducing hydrogen atoms, these gases may further be admixed at a desired level with a gas of a silicon compound containing hydrogen atoms.

Also, the respective gases may be used not only as single species but as a mixture of plural species.

For formation of a first amorphous layer (I) comprising a-Si(H,X) according to the reactive sputtering method or the ion plating method, for example, in case of the sputtering method, sputtering may be effected by use of a target of Si in a certain gas plasma atmosphere; or in case of the ion plating method, a polycrystalline silicon or a single crystalline silicon is placed as a vapor source in a vapor deposition boat and the silicon vapor source is vaporized by heating according to the resistance heating method or the electron beam method (EB method), and the resultant flying vaporized product is permitted to pass through the gas plasma atmosphere.

During this procedure, in either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halide containing hydrogen atom as one of the constituents such as hydroven halide, including HF, HCl, HBr, HI and the like or halogen substituted hydrogenated silicon, including $SiH_2F_2$, $SiH_2I_2$, $SiH_2Cl_2$, $SiHCl_3$, $SiH_2Br_2$, $SiBHr_3$ and the like as an effective starting material for formation of a first amorphous layer (I).

These halides containing hydrogen atom, which can introduce hydrogen atoms very effective for controlling electrical or photoelectric characteristics into the layer during formation of the first amorphous layer (I) simultaneously with introduction of halogen atoms, can preferably be used as the starting material for introduction of halogen atoms.

For incorporation of hydrogen atoms structurally into the first amorphous layer (I), other than the above method, $H_2$ or a gas of hydrogenated silicon, including $SiH_4$, $Si_2H_6$, $Si_3H_8$ and $Si_4H_{10}$ and so on may be permitted to be copresent with a silicon compound for supplying Si in a deposition chamber, wherein discharging is excited.

For example, in case of the reactive sputtering method, an Si target is used, and a gas for introduction of halogen atoms and $H_2$ gas are introduced together with, if necessary, an inert gas such as He, Ar, etc. into a deposition chamber, wherein a plasma atmosphere is formed to effect sputtering with said Si target, thereby forming the first amorphous layer (I) comprising a-Si(H,X) on the substrate.

Further, there may be introduced a gas such as of $B_2H_6$ or others in order to effect also doping of impurities.

The amount of hydrogen atoms (H) or halogen atoms (X) incorporated in the first amorphous layer (I) of the photoconductive member, or total amount of both of these atoms, may be preferably 1 to 40 atomic %, more preferably 5 to 30 atomic %.

For controlling the amounts of hydrogen atoms (H) and/or halogen atoms (X) in the first amorphous layer (I), the support temperature and/or the amount of the starting material for incorporation of hydrogen atoms (H) or halogen atoms (X) to be introduced into the deposition device system or the discharging power may be controlled.

In the present invention, as a diluting gas to be used in formation of the first amorphous layer (I) by the glow discharge method or the sputtering method, there may be preferably employed a so called rare gas such as He, Ne, Ar and the like.

For formation of the first layer region (O) and the second layer region (III) by introducing oxygen atoms and the group III atoms into the first amorphous layer (I), a starting material for introduction of the group III atoms or a starting material for introduction of oxygen atoms, or both materials may be used together with the starting material for formation of the first amorphous layer (I) as mentioned above during formation of the layer by the glow discharge method or the reactive sputtering method, and those atoms may be incorporated in the layer while controlling the amount of those materials.

When the glow discharge method is to be employed for formation of the first layer region (O) constituting the amorphous layer (I), the starting material as the starting gas for formation of the first layer region (O) may be constituted by adding a starting material for introduction of oxygen atoms to the starting material selected as desired from those for formation of the first amorphous layer (I) as mentioned above. As such a starting material for introduction of oxygen atoms, there may be employed most of gaseous or gasifiable substances containing at least oxygen atoms as constituent atoms.

For example, there may be employed a mixture of a starting gas containing silicon atoms (Si) as constituent atoms, a starting gas containing oxygen atoms (O) as contituent atoms and optionally a starting gas containing hydrogen atoms (H) or/and halogen atoms (X) as constituent atoms at a desired mixing ratio; a mixture of a starting gas containing silicon atoms (Si) as constituent atoms and a starting gas containing oxygen atoms (O) and hydrogen atoms (H) as constituent atoms also at a desired mixing ratio; or a mixture of a starting gas containing silicon atoms (Si) as constituent atoms and a starting gas containing the three kinds of silicon atoms (Si), oxygen atoms (O) and hydrogen atoms (H) as constituent atoms.

Alternatively, there may also be employed a mixture of a starting gas containing silicon atoms (Si) and hydrogen atoms (H) as constituent atoms and a starting gas containing oxygen atoms (O) as constituent atoms.

More specifically, there may be mentioned, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane $H_3SiOSiH_3$, trisiloxane $H_3SiOSiH_2OSiH_3$, and the like.

For formation of the first layer region (O) containing oxygen atoms according to the sputtering method, a single crystalline or polycrystalline Si wafer or $SiO_2$ wafer or a wafer containing Si and $SiO_2$ mixed therein may be employed and sputtering with these wafers may be conducted in various gas atmospheres.

For example, when Si wafer is employed as the target, a starting gas for introduction of oxygen atoms optionally together with a starting gas for introduction of hydrogen atoms or/and halogen atoms, which may optionally be diluted with a diluting gas, may be introduced into a deposition chamber for sputtering to form gas plasma of these gases, in which sputtering with the aforesaid Si wafer may be effected.

Alternatively, by use of separate targets of Si and $SiO_2$ or one sheet of a target containing Si and $SiO_2$ mixed therein, sputtering may be effected in an atmosphere of a diluting gas as a gas for sputtering or in a gas atmosphere containing at least hydrogen atoms (H) or/and halogen atoms (X) as constituent atoms. As the starting gas for introduction of oxygen atoms, there may be employed the starting gases shown as examples in the glow discharge method previously described also as effective gases in case of sputtering.

For formation of the second layer region (III) constituting the first amorphous layer (I), a gaseous or gasifiable starting material for introduction of the group III atoms may be introduced under gaseous state together with the starting gas for formation of the amorphous layer (I) as mentioned above during formation of the first amorphous layer (I) as described above into a vacuum deposition chamber for formation of the first amorphous layer (I).

The content of the group III atoms to be introduced into the second layer region (III) may be controlled freely by controlling the gas flow rate of the starting materials for introduction of the group III atoms to be flown into the deposition chamber, the gas flow rate ratio, the discharging power and others.

As the starting material for introduction of the group III atoms, which can effectively used in the present invention, there may be included hydrogenated boron such as $B_2H_6$, $B_4H_{10}$, $B_5H_9$, $B_5H_{11}$, $B_6H_{10}$, $B_6H_{12}$, $B_6H_{14}$, etc., and halogenated boron such as $BF_3$, $BCl_3$, $BBr_3$, etc, for introduction of boron atoms. In addition, there may also effectively be used $AlCl_3$, $GaCl_3$, $Ga(CH_3)_3$, $InCl_3$, $TlCl_3$, etc.

In the present invention, formation of the transition layer region (the layer region where either of the distribution concentrations of oxygen atoms or the group III atoms is varied in the layer thickness) can be achieved by varying suitably the flow rate of the gas containing the component of which concentration should be varied. For example, by the manual method or any other method conventionally used such as an externally driven motor, etc., the opening of a certain needle valve provided in the course of the gas flow channel system may be gradually varied. During this procedure, the variation rate of the gas flow rate is not necessarily required to be linear, but the flow rate may be controlled according to a variation rate curve previously designed by means of, for example, a microcomputer to give a desired content curve.

At the boundary between the transition layer region and other layer regions, during preparation of the amorphous layer (I), the plasma state may be either maintained or intermitted without any influence on the characteristics of the layer, but it is preferred to operate continuously, also from the standpoint of the process control.

In the present invention, the first amorphous layer (I) may have a layer thickness, which may suitably be determined depending on the characteristics required for the photoconductive member to be prepared, but it may be preferably 1 to 100$\mu$, more preferably 1 to 80$\mu$, most preferably 2 to 50$\mu$.

In FIG. 1, photoconductive member 100 has a second amorphous layer (II) 107 formed on the first amorphous layer (I) 102. The second amorphous layer (II) 107 has a free surface 108, and serves to improve mainly humidity resistance, continuous repeating use characteristics, dielectric strength, use environmental characteristics, and durability.

In the present invention, both the first and the second amorphous layers (I) and (II) are composed of a common constituent element, that is, silicon as an amorphous material, so that the laminating interface is sufficiently chemically stable.

In the present invention, the second amorphous layer (II) is composed of a-SiC, a-SiCH, a-SiCX, or a-SiC(H+X) [these materials are hereinafter generally represented by a-SiC(H,X)].

The second amorphous layer (II) may be formed by glow discharge method, sputtering method, ion implantation method, ion plating method, electron beam method or the like. These methods are appropriately selected depending upon the production conditions, capital investment, scale of production, desired characteristics of the photoconductive member to be produced and the like.

Electron beam method, ion plating method, glow discharge method and sputtering method are preferably employed since the production conditions for obtaining desired characteristics of the photoconductive members can be easily controlled and it is easy to introduce carbon atoms, if desired, hydrogen and/or halogen together with silicon atoms ihto the second amorphous layer.

For producing the second amorphous layer (II) composed of a-SiC by a sputtering method, a single crystalline or polycrystalline Si wafer and a C wafer, or a wafer containing both Si and C mixed, is used as a target, and sputtering is effected in a gas atmosphere.

For example, when Si wafer and C wafer are used as targets, a sputtering gas such as He, Ne, Ar and the like is introduced into a deposition chamber for sputtering to form gas plasma, and sputtering is effected.

Alternatively, one sheet of target composed of Si and C mixed is used, and a gas for sputtering is introduced into a deposition chamber to effect sputtering in an atmosphere of the gas.

When an electron beam method is employed, a single cyrstalline or polycrystalline silicon of high purity and a graphite of high purity may be placed separately in two boats, respectively followed by applying electron beams to the silicon and the graphite, respectively. Alternatively, both silicon and graphite at a desired mixing ratio may be placed in a single boat, and a single electron beam may be applied to effect deposition.

The content ratio of silicon atoms to carbon atoms in the resulting second amorphous layer (II) is controlled in the former by independently applying electron beams to the silicon and the graphite while in the latter the content ratio is controlled by determining preliminarily the content ratio of silicon to graphite in the mixture.

When an ion plating method is used, a variety of gases may be introduced into a deposition chamber, and a high frequency electric field may be preliminarily applied to a coil arranged around the chamber to cause a glow, under which condition deposition of Si and C may be effected by using an electron beam method.

When a glow discharge method is used for forming a second amorphous layer (II) with a-SiCH, a starting gas for producing a-SiCH, if desired, mixed with a diluting gas at a predetermined ratio, may be introduced into a deposition chamber for vacuum deposition, and the gas thus introduced may be made into a gas plasma by a glow discharge to deposit a-SiCH on a first amorphous layer (I) which has been already formed on a support.

As the gases for forming a-SiCH, there may be used most of gaseous or gasifiable materials which can supply Si, C and H.

Combinations of the materials are, for example, as shown below.

A starting gas containing Si as a constituent atom, a starting gas containing C as a constituent atom and a starting gas containing H as a constitutent atom may be mixed at a desired ratio and used.

Alternatively, a starting gas containing Si as a constituent atom and a starting gas containing C and H as constituent atoms may be mixed at a desired ratio and used.

Further alternatively, a starting gas containing Si as a constituent atom and a gas containing Si, C and H as constituent atoms may be mixed at a desired ratio and used.

Still further alternatively, a starting gas containing Si and H as constituent atoms and a starting gas containing C as a constituent atom may be mixed at a desired ratio and used.

Starting gases used for forming effectively the second amorphous layer (II) include hydrogenated silicon gas containing Si and H as constituent atoms, for example, silanes such as $SiH_4$, $Si_2H_6$, $Si_3H_8$, $Si_4H_{10}$ and the like, and compounds containing C and H as constituent atoms, for example, saturated hydrocarbons of $C_{1-5}$, ethylenic hydrocarbons of $C_{2-5}$, acetylenic hydrocarbons of $C_{2-4}$ and the like.

More particularly, as saturated hydrocarbons, there may be mentioned methane ($CH_4$), ethane ($C_2H_6$), propane ($C_3H_8$), n-butane (n-$C_4H_{10}$), pentane ($C_5H_{12}$), and the like. As ethylenic hydrocarbons, there may be mentioned ethylene ($C_2H_4$), propylene ($C_3H_6$), butene-1 ($C_4H_8$), butene-2 ($C_4H_8$), isobutylene ($C_4H_8$), pentene ($C_5H_{10}$) and the like. As acetylenic hydrocarbons, there may be mentioned acetylene ($C_2H_2$), methylacetylene ($C_3H_4$), butyne ($C_4H_6$) and the like.

As starting gases containing Si, C and H as constituent atoms, there may be mentioned alkyl silanes such as $Si(CH_3)_4$, $Si(C_2H_5)_4$ and the like. Other than the above mentioned starting gases, as a starting gas for introducing H, there may be naturally used $H_2$.

For producing a second amorphous layer (II) with a-SiCH by sputtering, a single crystalline or polycrystalline Si wafer, or C wafer, or a wafer containing both Si and C as a mixture may be used as a target, and sputtering may be effected in a variety of gas atmosphere.

For example, when an Si wafer is used as a target, starting gases for introducing C and H may be diluted by a diluting gas, if desired, and introduced into a deposition layer for sputtering to produce gas plasma of said gases and then sputtering may be effected.

Alternatively, Si and C may be made into separated targets or into one single target composed of a mixture of Si and C, and these targets may be used in a gas atmosphere containing at least hydrogen atoms to conduct sputtering.

As starting gases for introducing C or H, the starting gases as mentioned above with respect to glow discharge may be used effectively also in case of sputtering.

For producing a second amorphous layer (II) with a-SiCX by the glow discharge method, a starting gas or starting gases for forming a-SiCX, if desired, mixed with a diluting gas at a predetermined ratio, may be introduced into a deposition chamber for vacuum deposition, and glow discharge may be caused to make the gas or gases into gas plasma, and as a result, a-SiCX may be deposited on the first amorphous layer (I) previously formed on the support.

As a gas or gases for producing a-SiCX, there may be used most gaseous or gasifiable material or materials containing at least one of Si, C and X as constituent atom.

When a starting gas containing Si as a constituting atoms is used, for example, there may be used a starting gas containing Si as a constituting atom, a starting gas containing C as a constituting atom and a starting gas containing X as a constituting atom which are mixed at a desired ratio; or there may be used a starting gas containing Si as a constituting atom and a starting gas containing C and X as constituting atoms which are mixed at a desired ratio; or there may be used a starting gas containing Si as a constituting atom and a starting gas containing Si, C and X as constituting atoms which are in a form of a mixture; or there may be used a starting gas containing Si and X as constituting atoms and a starting gas containing C as a constituting atom which are in a form of a mixture.

As halogen atoms (X) incorporated in the second amorphous layer (II), F, Cl, Br and I may be used, and F and Cl are particularly preferable.

When the second amorphous layer (II) is constituted of a-SiCX, it is possible to incorporate additionally hydrogen atoms in said layer. In this case, one starting gas for forming the first amorphous layer (I) to introduce at least H may be also used for introducing H into the second amorphous layer (II) so that the production cost can be lowered when the production of the first second amorphous layers are carried out continuously.

As starting gases for producing the second amorphous layer (II) with a-SiCX or a-SiC(X+H), there may be used the starting gases as mentioned in the case of a-SiCH and other starting gases such as halogen, hydrogen halides, interhalogen compounds, silicon halides, halogen-substituted silicon hydrides, silicon hydrides and the like. As the above mentioned halogen series materials, there may be particularly mentioned:

halogen gases such as fluorine, chlorine, bromine and iodine;

hydrogen halides such as HF, HI, HCl, and HBr;

interhalogen compounds such as BrF, ClF, $ClF_3$, $ClF_5$, $BrF_5$, $BrF_3$, $IF_7$, $IF_5$, ICl, IBr, and the like;

silicon halides such as $SiF_4$, $Si_2F_6$, $SiCl_4$, $SiCl_3Br$, $SiCl_2Br_2$, $SiClBr_3$, $SiCl_3I$, $SiBr_4$ and the like;

halogen-substituted silicon hydrides such as $SiH_2F_2$, $SiH_2Cl_2$, $SiHCl_3$, $SiH_3Cl$, $SiH_3Br$, $SiH_2Br_2$, $SiHBr_3$ and the like.

In addition, the halogen series materials include halogen substituted paraffin hydrocarbons such as $CCl_4$, $CHF_3$, $CH_2F_2$, $CH_3F$, $CH_3Cl$, $CH_3Br$, $CH_3I$, $C_2H_5Cl$ and the like; sulfur fluorides such as $SF_4$, $SF_6$ and the like; and silane derivatives, for example, halogen containing alkyl silanes such as $SiCl(CH_3)_3$, $SiCl_2(CH_3)_2$, $SiCl_3CH_3$ and the like.

For producing a second amorphous layer (II) with a-SiCX or a-SiC(H+X) by sputtering, a single crystalline or polycrystalline Si wafer or C wafer or a wafer containing a mixture of Si and C may be used as a target and sputtering may be carried out in a gase atmosphere containing halogen atoms, if desired, hydrogen atoms as constituting atoms.

For example, when an Si wafer is used as a target, a starting gas for introducing C and X, if desired, together with a diluting gas, may be introduced into a deposition chamber for sputtering, and gas plasma of the gas may be formed, and sputtering may be effected.

Alternatively, Si and C are used as separate targets or a mixture of Si and C is used as one sheet of target, and sputtering is effected in a gas atmosphere containing at least halogen atoms.

As materials for starting gases for introducing C and X, if desired, H, the materials for forming a second amorphous layer (II) as shown in the above mentioned glow discharge case may be used as effective materials for sputtering.

In the present invention, starting materials for forming a second amorphous layer (II) are selected in such a way that silicon atoms, carbon atoms, if desired, hydrogen atoms and/or halogen atoms can be incorporated in the second amorphous layer (II) at a predetermined ratio.

For example, a second amorphous layer (II) composed of a-$Si_xC_{1-x}$:Cl:H can be produced by introducing $Si(CH_3)_4$ and a halogen introducing material such as $SiHCl_3$, $SiCl_4$, $SiH_2Cl_2$, $SiH_3Cl$, and the like in gaseous states at a predetermined ratio into a device for forming a second amorphous layer (II) followed by a glow discharge. $Si(CH_3)_4$ is capable of supplying silicon, carbon and hydrogen atoms and further forming desired characteristics of a second amorphous layer (II).

As a diluting gas used in forming a second amorphous layer (II) by a glow discharge or sputtering method, there may be preferably mentioned rare gases such as He, Ne, Ar and the like.

Upon forming the second amorphous layer (II) of the present invention, it is preferable to produce the layer carefully so as to impart desired characteristics thereto. That is, since the above mentioned a-SiC(H, X) constituting the second amorphous layer (II) exhibits electric properties ranging from electroconductivity to semiconductive property, and further to insulating property and also ranging from photoconductivity to non-photoconductivity depending upon the conditions for formation of the second amorphous layer (II), it is preferable to select the conditions appropriately so as to obtain desired properties achieving the object of the invention.

For example, in case that the second amorphous layer (II) is provided for improving mainly the dielectric strength, the amorphous material, a-SiC(H,X) formed should be remarkably electrically insulating under the use environment.

Further, in case that the second amorphous layer (II) is provided for improving mainly the continuous repeating use characteristics and the use environment characteristics, the degree of electrical insulating property as mentioned above may be somewhat low, and it is sufficient for the purpose that the amorphous material formed has a sensitivity to an irradiating light to some extent.

Upon forming a second amorphous layer (II) composed of the above mentioned a-SiC(H,X) on a first amorphous layer (I), the support temperature during forming the layer is an important factor affecting the constitution and characteristics of the resulting layer. Therefore, it is preferable to control the support temperature so as to impart desired characteristics to the second amorphous layer (II).

The support temperature to be employed depends on the method for forming the second amorphous layer (II).

In the case of using a-SiC, the support temperature is preferably 20°-300° C., more preferably 20°-250° C.

In the case of using the other amorphous materials for forming the second amorphous layer (II), the support temperature is preferably 100°-300° C., more preferably 150°-250° C.

For producing the second amorphous layer (II), sputtering methods and electron beam methods are advantageous since controlling delicately the atomic composition ratio of the atoms constituting the layer and controlling the layer thickness as compared with other methods. When these layer forming methods are used for forming the second amorphous layer (II), the discharge power upon layer formation as well as the support temperature is an important factor affecting the characteristics of the amorphous material formed.

For the purpose of producing effectively the abovementioned a-SiC(H,X) having the desirable characteristics at a good productivity, the discharge power is preferably 50-250 W, more preferably 80-150 W in case of a-SiC. The discharge power is preferably 10-300 W, more preferably 20-200 W in case of other amorphous materials for forming the second amorphous layer (II).

The gas pressure in the deposition chamber is usually 0.01-1 torr, preferably about 0.1-0.5 torr.

It is not desirable that the abovementioned desirable values of the support temperature and discharge power for producing the second amorphous layer (II) are separately or independently determined, but it is desirable that these layer forming conditions are determined mutually dependently with an intimate relation between them so as to produce the second amorphous layer (II) composed of the a-SiC(H,X) having desirable characteristics.

The contents of carbon atoms, hydrogen atoms and halogen atoms contained in the a-SiC(H,X) constituting the second amorphous layer (II) as well as the above-mentioned second amorphous layer forming conditions are also important factors to obtain the layer having desirable characteristics.

The content of each atom in the a-SiC(H,X) constituting the second amorphous layer (II) is usually as shown above. Further, when the content is as shown below, better results can be obtained.

In the case of $Si_aC_{1-a}$, the value of a is preferably $0.4<a<0.99999$, more preferably $0.5<a<0.99$, most preferably $0.5\leqq a\leqq 0.9$.

In the case of $[Si_bC_{1-b}]_cH_{1-c}$, the value of b is preferably $0.5<b\leqq 0.99999$, more preferably $0.5\leqq b\leqq 0.99$, most preferably $0.5\leqq b\leqq 0.9$, and the value of c is preferably $0.6\leqq c\leqq 0.99$, more preferably $0.65\leqq c\leqq 0.98$, most preferably $0.7\leqq c\leqq 0.95$.

In the cases of $[Si_dC_{1-d}]_eX_{1-e}$ and $[Si_fC_{1-f}]_g(H+X)_{1-g}$, the values of d and f are preferably $0.47<d$, $f\leqq 0.99999$, more preferably $0.5\leqq d$, $f\leqq 0.99$, most preferably $0.5\leqq d$, $f\leqq 0.9$, and the values of e and g are preferably $0.8\leqq e$, $g\leqq 0.99$, more preferably $0.82\leqq e$, $g\leqq 0.99$, most preferably $0.85\leqq e$, $g\leqq 0.98$.

In the case of $[Si_fC_{1-f}]_g(H+X)_{1-g}$, the content of hydrogen atoms is preferably not more than 19 atomic %, more preferably not more than 13 atomic % based on the total amount.

The thickness of the second amorphous layer (II) may be appropriately selected so as to achieve the purpose of the present invention effectively.

The thickness of the second amorphous layer (II) may be appropriately determined depending on the relation with the thickness of the first amorphous layer (I) and economical conditions such as productivity, mass production and the like.

The thickness of the second amorphous layer (II) is preferably 0.01–10 microns, more preferably 0.02–5 microns, most preferably 0.04–5 microns.

The total thickness of the layer constituting the photoconductive member of the present invention may be appropriately determined depending on the uses such as reading devices, image pick-up devices, image forming members for electrophotography.

The total thickness of the constituting layer may be appropriately determined depending on the relation between the thickness of the first amorphous layer (I) and that of the second amorphous layer (II) so that the characteristics of each of the first and second amorphous layers (I) and (II) can be effectively exhibited. The thickness of the first amorphous layer (I) is preferably from several hundreds to several thousands or more times the thickness of the second amorphous layer (II).

The total thickness of the constituting layer is preferably 3–100 microns, more preferably 5–70 microns, most preferably 5–50 microns.

The support for the photoconductive member to be used in the present invention may be either electroconductive or insulating. As the electroconductive material, there may be mentioned metals such as NiCr, stainless steel, Al, Cr, Mo, Au, Nb, Ta, V, Ti, Pt, Pd, etc. or alloys thereof.

As insulating supports, there may be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating supports have preferably at least one side surface subjected to electroconductive treatment, and it is desirable to provide another layer on the surface side to which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($IN_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10μ or more from the points of fabrication and handling of the support as well as its mechanical strength.

The photoconductive member of the present invention designed to have such a layer constitution as described above can overcome all of the problems as mentioned above and exhibit very excellent electrical, optical, photoconductive characteristics, as well as good environmental characteristics in use.

In particular, when it is applied as an image forming member for electrophotography, it is excellent in charge retentivity in charging treatment without any influence of residual potential on image formation at all, being stable in its electrical properties with high sensitivity and having high SN ratio as well as excellent light fatigue resistance and repeated usage characteristics, whereby it is possible to obtain repeatedly images of high quality with high density, clear halftone and high resolution.

Next, an example of the process for producing the photoconductive member is to be outlined.

Figure 11:
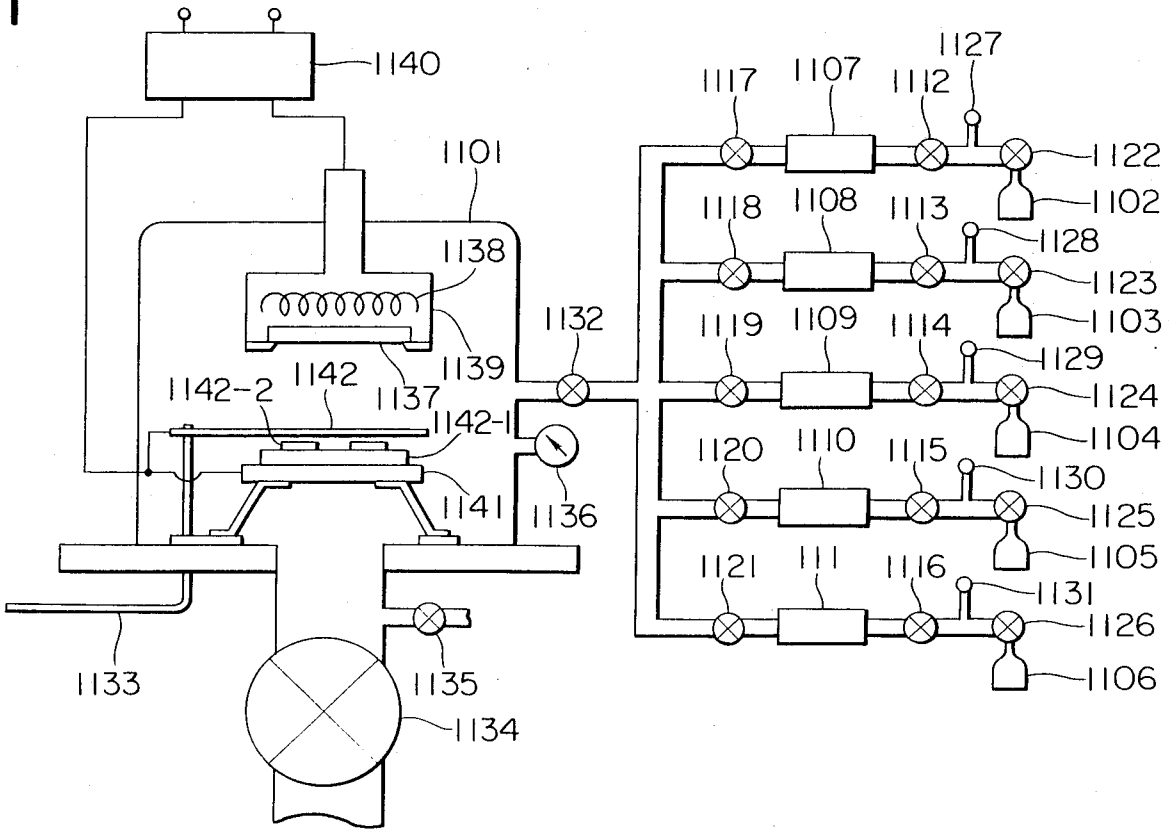
FIG. 11 a schematic flow chart for illustration of the device used for preparation of the photoconductive members of the present invention.

FIG. 11 shows a device for producing a photoconductive member.

In the gas bombs 1102, 1103, 1104, 1105 and 1106 there are hermetically contained starting gases for formation of respective layers of the present invention. For example, 1102 is a bomb containing $SiH_4$ gas (purity: 99.999%) diluted with He (hereinafter abbreviated as "$SiH_4$/He"), 1103 is a bomb containing $B_2H_6$ gas (purity: 99.999%) diluted with He (hereinafter abbreviated as "$B_2H_6$/He"), 1104 is a bomb containing Ar gas (purity: 99.999%), 1105 is a bomb containing NO gas (purity: 99.999%), and 1106 is a bomb containing $SiF_4$ gas (purity: 99.999%) diluted with He (hereinafter abbreviated as "$SiF_4$/He").

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes about $5\times10^{-6}$ Torr, the auxiliary valve 1132, 1133, the inflow valves 1112–1116 and the outflow valves 1117–1121 are closed.

Then, the valves of the gas pipelines connected to the bombs of the gases to be introduced into the reaction chamber 1101 are operated as scheduled to introduce the desired gases into the reaction chamber.

In the following, one example of preparing a photoconductive member having a first amorphous layer (I) and a second amorphous layer (II) on said layer (I) having the same layer constitution as shown in FIG. 1 is to be briefly described.

$SiH_4$/He gas from the gas bomb 1102, $B_2H_6$/He gas from the gas bomb 1103 and NO gas from the gas bomb 1105 are permitted to flow into the massflow controllers 1107, 1108, 1110 by opening the valves 1122, 1123 and 1125 by controlling the the pressures at the outlet pressure gauges 1127, 1128 and 1130 to 1 Kg/cm$^2$ and opening gradually the inflow valves 1112, 1113 and 1115. Subsequently, the outflow valves 1117, 1118, 1120 and the auxiliary valve 1132 are gradually opened to permit respective gases to flow into the reaction chamber 1101. The outflow valves 1117, 1118 and 1120 are controlled so that the relative flow rate ratios between $SiH_4$/He, $B_2H_6$/He and NO gases may have desired values and opening of the main valve 1134 is also controlled while watching the reading on the vacuum indicator 1136 so that the pressure in the reaction chamber 1101 may reach a desired value. And, after confirming that the temperature of the substrate 1137 is set at 50°–400° C. by the heater 1138, the power source 1140 is set at a desired power to excite glow discharge in the reaction chamber 1101, while simultaneously performing the operation to change gradually the flow rates of $B_2H_6$/He gas and NO gas in accordance with a predetermined change ratio curve by changing the valves 1118 and 1120 gradually by the manual method or by means of an externally driven motor, thereby controlling the contents of boron atoms and oxygen atoms in the layer, thereby forming a layer region ($t_1$ $t_B$).

At the time when the layer region ($t_1$ $t_B$) has been formed, the valves 1118 and 1120 are completely closed, and the layer formation is carried out thereafter only with the use of $SiH_4$/He gas, and consequently the layer region ($t_s$ $t_1$) is formed to a desired layer thickness on the layer region ($t_1$ $t_B$) to complete formation of the first amorphous layer (I).

After the amorphous layer (I) has been formed to a desired layer thickness with desired depth profiles of the group III atoms and oxygen atoms to be contained therein, the outflow valve 1117 is once completely closed, with intermission of discharging.

As the species of the starting gas to be employed for formation of the first amorphous layer (I), other than $SiH_4$ gas, $Si_2H_6$ gas is particularly effective for improvement of the layer formation speed.

When halogen atoms are to be incorporated in the first amorphous layer (I), other gases such as $SiF_4$/He are further added to the above gases and charged into the reaction chamber 1101.

Formation of the second amorphous layer (II) on the first amorphous layer (I) may be carried out, for example, as follows. First, the shutter 1142 is opened. All the gas supplying valves are once closed, the reaction chamber 1101 is evacuated by full opening of the main valve 1134.

On the electrode 1141 on which high voltage power is to be applied, there are provided targets of a high purity silicon wafer 1142-1 and a high purity graphite wafer 1142-2 with a desired area ratio. From the gas bomb 1105, Ar gas is introduced into the reaction chamber 1101, and the main valve 1134 is controlled so that the inner pressure in the reaction chamber 1101 may become 0.05 to 1 Torr. The high voltage power source 1140 is turned on to effect sputtering on the aforesaid target, whereby the second amorphous layer (II) can be formed on the first amorphous layer (I).

The content of the carbon atoms to be contained in the second amorphous layer (II) can be controlled as desired by controlling the area ratio of the silicon wafer to the graphite wafer, or the mixing ratio of the silicon powders to the graphite powders during preparation of the target.

For formation of the second amorphous layer (II) according to the glow discharge method, $SiH_4$ gas, $SiF_4$ gas and $C_2H_4$ gas may be permitted to flow into the raaction chamber 1101 at a predetermined flow rate ratio by the same valve operation as in formation of the first amorphous layer (I), followed by excitation of glow discharging. Before carrying out this procedure, the respective bombs are replaced with the bombs filled with gases necessary for formation of the layer.

EXAMPLE 1

An image forming member for electrophotography having an amorphous layer (I) having the layer constitution as shown in FIG. 3 on an aluminum substrate was formed by means of the preparation device as shown in FIG. 11. The conditions for forming the respective layer regions constituting the amorphous layer (I) and the amorphous layer (II) are shown in Table 1 below.

Distribution concentration of oxygen $C_{(O)1}$: 3.5 atomic %

Distribution concentration of boron $C_{(III)1}$: 80 atomic ppm

The image forming member prepared was evaluated comprehensively by superiority or inferiority of density, resolution and halftone reproducibility of the image visualized on a transfer paper after a series of electrophotographic process of charging-imagewise exposure-development-transfer.

TABLE 1

| Layer constitution | Gases employed (Vol %) | Flow rate (SCCM) | Flow rate ratio | Layer formation speed (Å/S) | Layer thickness (μ) |
|---|---|---|---|---|---|
| Amorphous | | | | | |

TABLE 1-continued

| Layer constitution | Gases employed (Vol %) | Flow rate (SCCM) | Flow rate ratio | Layer formation speed (Å/S) | Layer thickness (μ) |
|---|---|---|---|---|---|
| layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 4 \times 10^{-2}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 4 \times 10^{-2} \sim 2 \times 10^{-2}$<br>$B_2H_6/SiH_4 = 8 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 2 \times 10^{-2} \sim 0$<br>$B_2H_6/SiH_4 = 8 \times 10^{-5} \sim 0$ | 20 | 0.5 |
| Fourth layer region ($t_5t_1$) | $SiH_4/He = 0.5$ | $SiH_4 = 300$ | | 20 | 1 |
| Amorphous layer (II) | Ar | 200 | Si wafer:graphite = 4:6 (Area ratio) | 3 | 1 |

Al substrate temperature: 250° C.
Discharging frequency: 13.56 MHz
Inner pressure in reaction chamber:
First layer region ~ Fourth layer region 0.5 Torr
Amorphous layer (II) 0.2 Torr
Discharging power:
First layer region ~ Fourth layer region 0.18 W/cm$^2$
Amorphous layer (II) 0.30 W/cm$^2$

EXAMPLE 2

Image forming member were prepared according to entirely the same method as in Example 1 except that the area ratio of silicon wafer to graphite wafter during formation of the amorphous layer (II) was varied to change the content ratio of silicon atoms to carbon atoms in the layer (II). The results obtained are shown in Table 2.

TABLE 2

| | | | | | |
|---|---|---|---|---|---|
| Si:C (Area ratio) | 9:1 | 6.5:3.5 | 4:6 (Ex. 1) | 1.7:8.3 | 1:9 |
| Si:C (Content ratio) | 9.7:0.3 | 8.8:1.2 | 7.3:2.7 | 4.5:5.5 | 3.1:6.9 |
| Image quality evaluation | ○ | ◎ | ◎ | ○ | X |

◎: Very good
○: Good
X: Image defect liable to form

EXAMPLE 3

Image forming member were prepared according to entirely the same method as in Example 1 except for varying the layer thickness of the amorphous layer (II). By carrying out repeatedly the steps of image formation, development and cleaning, the following results were obtained.

TABLE 3

| Thickness of amorphous layer (II) (μ) | Results |
|---|---|
| 0.001 | Image defect liable to form |
| 0.02 | No image defect formed during 20,000 repetitions |
| 0.05 | Stable for 20,000 or more repetitions |
| 1 | Stable for 100,000 or more repetitions |

EXAMPLE 4

An image forming member for electrophotography having an amorphous layer (I) having the layer constitution as shown in FIG. 4 on an aluminum substrate was formed by means of the preparation device as shown in FIG. 11. The conditions for preparation of the respective layer regions constituting the amorphous layer (I) and the amorphous layer (II) are shown in Table 4 below.

Distribution concentration of oxygen $C_{(O)1}$: 7 atomic %
Distribution concentration of boron $C_{(III)1}$: 30 atomic ppm Using the image forming member for electrophotography obtained, toner images were formed repeatedly on transfer papers by applying electrophotographic process similarly as in Example 1, whereby toner transferred images of high quality could be obtained stably.

TABLE 4

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |

TABLE 4-continued

| Layer constitution | Gases employed (Vol %) | Flow rate (SCCM) | Flow rate ratio | Layer formation speed (Å/S) | Layer thickness (μ) |
|---|---|---|---|---|---|
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 3 \times 10^{-5}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 3 \times 10^{-5} \sim 1.5 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 0$<br>$B_2H_6/SiH_4 = 1.5 \times 10^{-5} \sim 0$ | 20 | 0.5 |
| Fourth layer region ($t_5t_1$) | $SiH_4/He = 0.5$ | $SiH_4 = 300$ | | 20 | 1 |
| Amorphous layer (II) | Ar | 200 | Si wafer:graphite = 1:1 (Area ratio) | 4 | 1.5 |

Al substrate temperature: 250° C.
Discharging frequency: 13.56 MHz
Inner pressure in reaction chamber:
First layer region ~ Fourth layer region 0.5 Torr
Amorphous layer (II) 0.2 Torr
Discharging power:
First layer region ~ Fourth layer region 0.2 W/cm$^2$
Amorphous layer (II) 0.3 W/cm$^2$

EXAMPLE 5

An image forming member for electrophotography having an amorphous layer (I) having the layer constitution as shown in FIG. 5 on an aluminum substrate was formed by means of the preparation device as shown in FIG. 11. The conditions for preparation of the respective layer regions constituting the amorphous layer (I) and the amorphous layer (II) are shown in Table 5 below.

Distribution concentration of oxygen $C_{(O)1}$: 7 atomic %
Distribution concentration of boron $C_{(III)1}$: 10 atomic ppm
Distribution concentration of boron $C_{(III)3}$: 5 atomic %

Using the image forming member for electrophotography obtained, toner images were formed repeatedly on transfer papers by applying electrophotographic process similarly as in Example 1, whereby toner transferred images of high quality could be obtained stably.

TABLE 5

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 1 \times 10^{-5}$ | 18 | 20 |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 5 \times 10^{-2}$<br>$B_2H_6/SiH_4 = 1 \times 10^{-5}$ | 18 | 0.5 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 5 \times 10^{-2} \sim 0$<br>$B_2H_6/SiH_4 = 1 \times 10^{-5} \sim 5 \times 10^{-6}$ | 18 | 0.3 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 5 \times 10^{-6}$ | 18 | 0.5 |
| Fifth layer region ($t_1t_2$) | $SiH_4/He = 0.5$<br>NO 100<br>$B_2H_6/He = 3 \times 10^{-3}$ | $SiH_4 = 200$ | $B_2H_6/SiH_4 = 5 \times 10^{-6} \sim 0$ | 18 | 0.3 |
| Sixth layer region ($t_5t_1$) | $SiH_4/He = 0.5$ | $SiH_4 = 300$ | | 18 | 0.3 |
| Amorphous | Ar | 200 | Si wafer:graphite = | 3 | 1 |

TABLE 5-continued

| Layer constitution | Gases employed (Vol %) | Flow rate (SCCM) | Flow rate ratio | Layer formation speed (Å/S) | Layer thickness (μ) |
|---|---|---|---|---|---|
| layer (II) | | | 4:6 (Area ratio) | | |

Al substrate temperature: 250° C.
Discharging frequency: 13.56 MHz
Inner pressure in reaction chamber:
First layer region~Sixth layer region 0.5 Torr
Amorphous layer (II) 0.2 Torr
Discharging power:
First layer region~Sixth layer region 0.18 W/cm$^2$
Amorphous layer (II) 0.3 W/cm$^2$

EXAMPLE 6

TABLE 6

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 1.1 \times 10^{-2}$<br>$B_2H_6/SiH_4 = 8 \times 10^{-5}$ | 20 | 20 |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 1.1 \times 10^{-2} \sim 7.4 \times 10^{-3}$<br>$B_2H_6/SiH_4 = 8 \times 10^{-5} \sim 1 \times 10^{-5}$ | 20 | 1.0 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 7.4 \times 10^{-3} \sim 0$<br>$B_2H_6/SiH_4 = 1 \times 10^{-5}$ | 20 | 0.5 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 1 \times 10^{-5}$ | 20 | 0.3 |
| Fifth layer region ($t_1t_2$) | $SiH_4/He = 0.5$<br>$B_2H_6/He = 3 \times 10^{-3}$ | $SiH_4 = 200$ | $B_2H_6/SiH_4 = 5 \times 10^{-6} \sim 0$ | 20 | 0.5 |
| Sixth layer region ($t_5t_1$) | $SiH_4/He = 0.5$ | $SiH_4 = 300$ | | 20 | 0.5 |
| Amorphous layer (II) | Ar | 200 | Si wafer:graphite = 1:1 (Area ratio) | 4 | 1.5 |

Al substrate temperature: 250° C.
Discharging frequency: 13.56 MHz
Inner pressure in reaction chamber:
First layer region~Sixth layer region 0.5 Torr
Amorphous layer (II) 0.2 Torr
Discharging power:
First layer region~Sixth layer region 0.18 W/cm$^2$
Amorphous layer (II) 0.3 W/cm$^2$ An image forming member for electrophotography having an amorphous layer (I) having the layer constitution as shown in FIG. 6 on an aluminum substrate was formed by means of the preparation device as shown in FIG. 11. The conditions for preparation of the respective layer regions constituting the amorphous layer (I) and the amorphous layer (II) are shown in Table 6 below.

Distribution concentration of oxygen $C_{(O)1}$: 1 atomic %
Distribution concentration of boron $C_{(III)1}$: 100 atomic ppm
Distribution concentration of boron $C_{(III)3}$: 10 atomic %

Using the image forming member for electrophotography obtained, toner images were formed repeatedly on transfer papers by applying electrophotographic process similarly as in Example 1, whereby toner transferred images of high quality could be obtained stably.

EXAMPLE 7

An image forming member for electrophotography having an amorphous layer (I) having the layer constitution as shown in FIG. 7 on an aluminum substrate was formed by means of the preparation device as shown in FIG. 11. The conditions for preparation of the respective layer regions constituting the amorphous layer (I) and the amorphous layer (II) are shown in Table 7 below.

Distribution concentration of oxygen $C_{(O)1}$: 2 atomic %
Distribution concentration of boron $C_{(III)1}$: 30 atomic ppm
Distribution concentration of boron $C_{(III)3}$: 5 atomic %

Using the image forming member for electrophotography obtained, toner images were formed repeatedly on transfer papers by applying electrophotographic process similarly as in Example 1, whereby toner transferred images of high quality could be obtained stably.

TABLE 7

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$B_2H_6/SiH_4 = 3 \times 10^{-5}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 2.2 \times 10^{-2} \sim 1.38 \times 10^{-2}$<br>$B_2H_6/SiH_4 = 3 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.38 \times 10^{-2} \sim 0$<br>$B_2H_6/SiH_4 = 3 \times 10^{-5} \sim 5 \times 10^{-6}$ | 20 | 0.3 |
| Fourth layer region ($t_5t_1$) | $SiH_4/He = 0.5$ | $SiH_4 = 300$ | $B_2H_6/SiH_4 = 5 \times 10^{-6}$ | 20 | 0.2 |
| Amorphous layer (II) | Ar | 200 | Si wafer:graphite = 4:6 (Area ratio) | 3 | 1 |

Al substrate temperature: 250° C.
Discharging frequency: 13.56 MHz
Inner pressure in reaction chamber:
First layer region~Fourth layer region 0.5 Torr
Amorphous layer (II) 0.2 Torr
Discharging power:
First layer region~Fourth layer region 0.2 W/cm$^2$
Amorphous layer (II) 0.3 W/cm$^2$

EXAMPLE 8

An image forming member for electrophotography having an amorphous layer (I) having the layer constitution as shown in FIG. 8 on an aluminum substrate was formed by means of the preparation device as shown in FIG. 11. The conditions for preparation of the respective layer regions constituting the amorphous layer (I) and the amorphous layer (II) are shown in Table 8 below.

Distribution concentration of oxygen $C_{(O)1}$: 2 atomic %
Distribution concentration of boron $C_{(III)1}$: 200 atomic ppm
Distribution concentration of boron $C_{(III)3}$: 5 atomic %

Using the image forming member for electrophotography obtained, toner images were formed repeatedly on transfer papers by applying electrophotographic process similarly as in Example 1, whereby toner transferred images of high quality could be obtained stably.

TABLE 8

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$B_2H_6/SiH_4 = 2 \times 10^{-4}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 2.2 \times 10^{-2} \sim 1.47 \times 10^{-2}$<br>$B_2H_6/SiH_4 = 2 \times 10^{-4} \sim 5 \times 10^{-6}$ | 20 | 0.3 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.47 \times 10^{-2} \sim 0$<br>$B_2H_6/SiH_4 = 5 \times 10^{-6}$ | 20 | 1.0 |
| Fourth layer region ($t_5t_1$) | $SiH_4/He = 0.5$<br>$B_2H_6/He = 3 \times 10^{-3}$ | $SiH_4 = 200$ | $B_2H_6/SiH_4 = 5 \times 10^{-6}$ | 20 | 2.0 |
| Amorphous | Ar | 200 | Si wafer:graphite = | 4 | 1.5 |

TABLE 8-continued

| Layer constitution | Gases employed (Vol %) | Flow rate (SCCM) | Flow rate ratio | Layer formation speed (Å/S) | Layer thickness (μ) |
|---|---|---|---|---|---|
| layer (II) | | | 1:1 (Area ratio) | | |

Al substrate temperature: 250° C.
Discharging frequency: 13.56 MHz
Inner pressure in reaction chamber:
First layer region~Fourth layer region 0.5 Torr
Amorphous layer (II) 0.2 Torr
Discharging power:
First layer region~Fourth layer region 0.2 W/cm$^2$
Amorphous layer (II) 0.3 W/cm$^2$

EXAMPLE 9

An image forming member for electrophotography having an amorphous layer (I) having the layer constitution as shown in FIG. 9 on an aluminum substrate was formed by means of the preparation device as shown in FIG. 11. The conditions for preparation of the respective layer regions constituting the amorphous layer (I) and the amorphous layer (II) are shown in Table 9 below.

Distribution concentration of oxygen $C_{(O)1}$: 5 atomic %
Distribution concentration of oxygen $C_{(O)3}$: 2 atomic %
Distribution concentration of boron $C_{(III)1}$: 50 atomic ppm Using the image forming member for electrophotography obtained, toner images were formed repeatedly on transfer papers by applying electrophotographic process similarly as in Example 1, whereby toner transferred images of high quality could be obtained stably.

EXAMPLE 10

An image forming member for electrophotography having an amorphous layer (I) having the layer constitution as shown in FIG. 2 on an aluminum substrate was formed by means of the preparation device as shown in FIG. 11. The conditions for preparation of the respective layer regions constituting the amorphous layer (I) and the amorphous layer (II) are shown in Table 10 below.

Distribution concentration of oxygen $C_{(O)1}$: 3.5 atomic %
Distribution concentration of boron $C_{(III)1}$: 80 atomic ppm
Distribution concentration of boron $C_{(III)3}$: 500 atomic ppm Using the image forming member for electrophotography obtained, toner images were formed repeatedly on transfer papers by applying electrophotographic process similarly as in Example 1, whereby toner transferred images of high quality could be obtained stably.

TABLE 9

| Layer constitution | Gases employed (Vol %) | Flow rate (SSCM) | Flow rate ratio | Layer formation speed (Å/S) | Layer thickness (μ) |
|---|---|---|---|---|---|
| Amorphous layer (I) | | | | | |
| First layer region ($t_2t_B$) | $SiH_4/He = 0.5$<br>NO 100<br>$B_2H_6/He = 3 \times 10^{-3}$ | $SiH_4 = 200$ | $NO/SiH_4 = 1.1 \times 10^{-2}$<br>$B_2H_6/SiH_4 = 4 \times 10^{-5}$ | 20 | 20 |
| Second layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.1 \times 10^{-2}$<br>$\sim 4.4 \times 10^{-3}$<br>$B_2H_6/SiH_4 = 4 \times 10^{-4}$ | 20 | 0.5 |
| Third layer region ($t_5t_1$) | $SiH_4/He = 0.5$ | $SiH_4 = 300$ | | 20 | 1 |
| Amorphous layer (II) | Ar | 200 | Si wafer:graphite = 4:6 (Area ratio) | 3 | 1 |

Al substrate temperature: 250° C.
Discharging frequency: 13.56 MHz
Inner pressure in reaction chamber:
First layer region~Third layer region 0.5 Torr
Amorphous layer (II) 0.2 Torr
Discharging power:
First layer region~Third layer region 0.2 W/cm$^2$
Amorphous layer (II) 0.3 W/cm$^2$

TABLE 10

| Layer constitution | Gases employed (Vol %) | Flow rate (SSCM) | Flow rate ratio | Layer formation speed (Å/S) | Layer thickness (μ) |
|---|---|---|---|---|---|
| Amorphous layer (I) | | | | | |
| First layer region ($t_4t_B$) | $SiH_4$/He = 0.5<br>NO 100<br>$B_2H_6$/He = $3.3 \times 10^{-3}$ | $SiH_4$ = 200 | NO/$SiH_4$ = $4 \times 10^{-2}$<br>$B_2H_6SiH_4$ = $5 \times 10^{-4}$ | 20 | 0.3 |
| Second layer region ($t_2t_4$) | $SiH_4$/He = 0.5<br>NO 100<br>$B_2H_6$/He = $3.3 \times 10^{-3}$ | $SiH_4$ = 200 | NO/$SiH_4$ = $4 \times 10^{-2}$~0<br>$B_2H_6$/$SiH_4$ = $8 \times 10^{-5}$~0 | 20 | 20 |
| Third layer region ($t_1t_2$) | $SiH_4$/He = 0.5<br>NO 100<br>$B_2H_6$/He = $3.3 \times 10^{-3}$ | $SiH_4$ = 200 | NO/$SiH_4$ = $4 \times 10^{-2}$~0<br>$B_2H_6$/$SiH_4$ = $8 \times 10^{-5}$~0 | 20 | 1 |
| Fourth layer region ($t_5t_1$) | $SiH_4$/He = 0.5 | $SiH_4$ = 300 | | 20 | 0.15 |
| Amorphous layer (II) | Ar | 200 | Si wafer:graphite = 4:6 (Area ratio) | 3 | 1 |

Al substrate temperature: 250° C.
Discharging frequency: 13.56 MHz
Inner pressure in reaction chamber:
First layer region~Fourth layer region 0.5 Torr
Amorphous layer (II) 0.2 Torr
Discharging power:
First layer region~Fourth layer region 0.2 W/cm$^2$
Amorphous layer (II) 0.3 W/cm$^2$

EXAMPLE 11

An image forming member for electrophotography having an amorphous layer (I) having the layer constitution as shown in FIG. 3 on an aluminum substrate was formed by means of the preparation device as shown in FIG. 11. The conditions for preparation of the respective layer regions constituting the amorphous layer (I) and the amorphous layer (II) are shown in Table 11 below.

Distribution concentration of oxygen $C_{(O)1}$: 3.5 atomic %

Distribution concentration of boron $C_{(III)1}$: 80 atomic ppm

Using the image forming member for electrophotography obtained, toner images were formed repeatedly on transfer papers by applying electrophotographic process similarly as in Example 1, whereby toner transferred images of high quality could be obtained stably.

TABLE 11

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4$/He = 0.5<br>$SiF_4$/He = 0.5<br>NO 100<br>$B_2H_6$/He = $3 \times 10^{-3}$ | $SiH_4$= 200 | NO/($SiH_4$ + $SiF_4$) = $4 \times 10^{-2}$<br>$SiF_4$/$SiH_4$ = 0.2<br>$B_2H_6$/($SiH_4$ + $SiF_4$) = $8 \times 10^{-5}$ | 20 | 20 |
| Second layer region ($t_2t_3$) | $SiH_4$/He = 0.5<br>$SiF_4$/He = 0.5<br>NO 100<br>$B_2H_6$/He = $3 \times 10^{-3}$ | $SiH_4$ = 200 | NO/($SiH_4$ + $SiF_4$) = $4 \times 10^{-2}$~$2 \times 10^{-2}$<br>$SiF_4$/$SiH_4$ = 0.2<br>$B_2H_6$/($SiH_4$ + $SiF_4$) = $8 \times 10^{-5}$ | 20 | 0.5 |
| Third layer region ($t_1t_2$) | $SiH_4$/He = 0.5<br>$SiF_4$/He = 0.5<br>NO 100<br>$B_2H_6$/He = $3 \times 10^{-3}$ | $SiH_4$ = 200 | NO/($SiH_4$ + $SiF_4$) = $2 \times 10^{-2}$~0<br>$SiF_4$/$SiH_4$ = 0.2<br>$B_2H_6$/($SiH_4$ + $SiF_4$) = $8 \times 10^{-5}$~0 | 20 | 0.5 |
| Fourth layer region ($t_5t_1$) | $SiH_4$/He = 0.5<br>$SiF_4$/He = 0.5 | $SiH_4$ = 300 | $SiF_4$/$SiH_4$ = 0.2 | 20 | 1 |
| Amorphous layer (II) | Ar | 200 | Si wafer:graphite = 4:6 (Area ratio) | 3 | 1 |

EXAMPLE 12

An image forming member for electrophotography having an amorphous layer (I) having the layer constitution as shown in FIG. 3 on an aluminum cylinder was formed by means of the preparation device as shown in FIG. 11. The conditions for preparation of the respective layer regions constituting the amorphous layer (I) and the amorphous layer (II) are shown in Table 12 below.

Distribution concentration of oxygen $C_{(O)1}$: 3.5 atomic %

Distribution concentration of boron $C_{(III)1}$: 80 atomic ppm

The image forming member prepared was evaluated comprehensively by superiority or inferiority of density, resolution and halftone reproducibility of the image visualized on a transfer paper after a series of electrophotographic process of charging-imagewise exposure-development-transfer.

TABLE 12

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 4 \times 10^{-2}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 4 \times 10^{-2} \sim 2 \times 10^{-2}$<br>$B_2H_6/SiH_4 = 8 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 2 \times 10^{-2} \sim 0$<br>$B_2H_6/SiH_4 = 8 \times 10^{-5} \sim 0$ | | |
| Fourth layer region ($t_5t_1$) | $SiH_4/He = 0.5$ | $SiH_4 = 300$ | | 20 | 1 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging frequency: 13.56 MHz
Inner pressure in reaction chamber: 0.5 Torr
Discharging power: 0.18 W/cm$^2$

EXAMPLE 13

Image forming members were prepared according to entirely the same method as in Example 12 except that the content ratio of silicon atoms to carbon atoms was varied in the amorphous layer (II) by varying the flow rate ratio of $SiH_4$ gas to $C_2H_4$ gas during formation of the amorphous layer (II). The results obtained are shown in Table 13.

TABLE 13

| Si:C (Content ratio) | 9.8:0.2 | 9.0:1.0 | 7.6:2.4 | 5.0:5.0 | 2.8:7.2 |
|---|---|---|---|---|---|
| Image quality evaluation | | | | | Δ |

o: Very good
Δ: Image defect liable to form

EXAMPLE 14

Image forming members were prepared according to entirely the same method as in Example 12 except for varying the layer thickness of the amorphous layer (II). By carrying out repeatedly the steps of image formation, development and cleaning, the following results shown in Table 14 were obtained.

TABLE 14

| Thickness of amorphous layer (II) (μ) | Results |
|---|---|
| 0.001 | Image defect liable to form |
| 0.02 | No image defect formed during 20,000 repetitions |
| 0.05 | Stable for 20,000 or more repetitions |
| 1 | Stable for 100,000 or more repetitions |

EXAMPLE 15

An image forming member for electrophotography having an amorphous layer (I) having the layer constitution as shown in FIG. 4 on an aluminum substrate was formed by means of the preparation device as shown in FIG. 11. The conditions for preparation of the respective layer regions constituting the amorphous layer (I) and the amorphous layer (II) are shown in Table 15 below.

Distribution concentration of oxygen $C_{(O)1}$: 7 atomic %

Distribution concentration of boron $C_{(III)1}$: 30 atomic ppm

Using the image forming member for electrophotography obtained, toner images were formed repeatedly on transfer papers by applying electrophotographic process similarly as in Example 12, whereby toner transferred images of high quality could be obtained stably.

TABLE 15

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First | $SiH_4/He = 0.5$ | $SiH_4 = 200$ | $NO/SiH_4 = 8 \times 10^{-2}$ | 20 | 20 |

TABLE 15-continued

| Layer constitution | Gases employed (Vol %) | Flow rate (SCCM) | Flow rate ratio | Layer formation speed (Å/S) | Layer thickness (μ) |
|---|---|---|---|---|---|
| layer region ($t_3t_B$) | NO 100<br>$B_2H_6/He = 3 \times 10^{-3}$ | | $B_2H_6/SiH_4 = 3 \times 10^{-5}$ | | |
| Second layer region ($t_2t_1$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 3.0 \times 10^{-5} \sim 1.5 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 0$<br>$B_2H_6/SiH_4 = 1.5 \times 10^{-5} \sim 0$ | 20 | 0.5 |
| Fourth layer region ($t_5t_1$) | $SiH_4/He = 0.5$ | $SiH_4 = 300$ | | 20 | 1 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging frequency: 13.56 MHz
Inner pressure in reaction chamber: 0.5 Torr
Discharging power: 0.2 W/cm$^2$

EXAMPLE 16

An image forming member for electrophotography having an amorphous layer (I) having the layer constitution as shown in FIG. 5 on an aluminum substrate was formed by means of the preparation device as shown in FIG. 11. The conditions for preparation of the respective layer regions constituting the amorphous layer (I) and the amorphous layer (II) are shown in Table 16 below.

Distribution concentration of oxygen $C_{(O)1}$: 7 atomic %
Distribution concentration of boron $C_{(III)1}$: 10 atomic ppm
Distribution concentration of boron $C_{(III)3}$: 5 atomic %

Using the image forming member for electrophotography obtained, toner images were formed repeatedly on transfer papers by applying electrophotographic process similarly as in Example 12, whereby toner transferred images of high quality could be obtained stably.

TABLE 16

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 1 \times 10^{-5}$ | 18 | 20 |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 5 \times 10^{-2}$<br>$B_2H_6SiH_4 = 1 \times 10^{-5}$ | 18 | 0.5 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 5 \times 10^{-2} \sim 0$<br>$B_2H_6/SiH_4 = 1 \times 10^{-5} \sim 5 \times 10^{-6}$ | 18 | 0.3 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 5 \times 10^{-6}$ | 18 | 0.5 |
| Fifth layer region ($t_1t_2$) | $SiH_4He = 0.5$<br>NO 100<br>$B_2H_6/He = 3 \times 10^{-3}$ | $SiH_4 = 200$ | $B_2H_6/SiH_4 = 5 \times 10^{-6} \sim 0$ | 18 | 0.3 |
| Sixth layer region ($t_5t_1$) | $SiH_4/He = 0.5$ | $SiH_4 = 300$ | | 18 | 0.3 |
| Amorphous Layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging power: 0.18 W/cm$^2$
Discharging frequency: 13.56 MHz
Inner pressure in reaction chamber: 0.5 Torr

EXAMPLE 17

An image forming member for electrophotography having an amorphous layer (I) having the layer constitution as shown in FIG. 6 on an aluminum substrate was formed by means of the preparation device as shown in FIG. 11. The conditions for preparation of the respective layer regions constituting the amorphous layer (I) and the amorphous layer (II) are shown in Table 17 below.

Distribution concentration of oxygen $C_{(O)1}$: 1 atomic %

Distribution concentration of boron $C_{(III)1}$: 100 atomic ppm

Distribution concentration of boron $C_{(III)3}$: 10 atomic %

Using the image forming member for electrophotography obtained, toner images were formed repeatedly on transfer papers by applying electrophotographic process similarly as in Example 12, whereby toner transferred images of high quality could be obtained stably.

TABLE 17

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 1.1 \times 10^{-2}$<br>$B_2H_6/SiH_4 = 1 \times 10^{-5}$ | 20 | 20 |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 1.1 \times 10^{-2} \sim 7.4 \times 10^{-3}$<br>$B_2H_6/SiH_4 = 8.0 \times 10^{-5} \sim 1 \times 10^{-5}$ | 20 | 1.0 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 7.4 \times 10^{-3} \sim 0$<br>$B_2H_6/SiH_4 = 1 \times 10^{-5}$ | 20 | 0.5 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 1 \times 10^{-5}$ | 20 | 0.3 |
| Fifth layer region ($t_1t_2$) | $SiH_4/He = 0.5$<br>$B_2H_6/He = 3 \times 10^{-3}$ | $SiH_4 = 200$ | $B_2H_6/SiH_4 = 1 \times 10^{-5} \sim 0$ | 20 | 0.5 |
| Sixth layer region ($t_St_1$) | $SiH_4/He = 0.5$ | $SiH_4 = 300$ | | 20 | 0.5 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging power: 0.18 W/cm$^2$
Discharging frequency: 13.56 MHz
Inner pressure in reaction chamber: 0.5 Torr

EXAMPLE 18

An image forming member for electrophotography having an amorphous layer (I) having the layer constitution as shown in FIG. 7 on an aluminum substrate was formed by means of the preparation device as shown in FIG. 11. The conditions for preparation of the respective layer regions constituting the amorphous layer (I) and the amorphous layer (II) are shown in Table 18 below.

Distribution concentration of oxygen $C_{(O)1}$: 2 atomic %

Distribution concentration of boron $C_{(III)1}$: 30 atomic ppm

Distribution concentration of boron $C_{(III)3}$: 5 atomic %

Using the image forming member for electrophotography obtained, toner images were formed repeatedly on transfer papers by applying electrophotographic process similarly as in Example 12, whereby toner transferred images of high quality could be obtained stably.

TABLE 18

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$B_2H_6/SiH_4 = 3 \times 10^{-5}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 2.2 \times 10^{-2} \sim 1.38 \times 10^{-2}$<br>$B_2H_6/SiH_4 = 3 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.38 \times 10^{-2} \sim 0$<br>$B_2H_6/SiH_4 = 3 \times 10^{-5} \sim 5 \times 10^{-6}$ | 20 | 0.3 |
| Fourth layer | $SiH_4/He = 0.5$<br>$B_2H_6/He = 3 \times 10^{-3}$ | $SiH_4 = 200$ | $B_2H_6/SiH_4 = 5 \times 10^{-6}$ | 20 | 0.2 |

TABLE 18-continued

| Layer constitution | Gases employed (Vol %) | Flow rate (SCCM) | Flow rate ratio | Layer formation speed (Å/S) | Layer thickness (μ) |
|---|---|---|---|---|---|
| region ($t_5t_1$) | | | | | |
| Amorphous layer (II) | $SiH_4$/He = 0.5<br>$C_2H_4$ | $SiH_4$ = 100 | $SiH_4$:$C_2H_4$ = 5:5 | 6 | 3 |

Substrature temperature: 250° C.
Discharging frequency: 13.56 MHz
Inner pressure in reaction chamber: 0.5 Torr
Discharging power: 0.2 W/cm$^2$

EXAMPLE 19

An image forming member for electrophotography having an amorphous layer (I) having the layer constitution as shown in FIG. 8 on an aluminum substrate was formed by means of the preparation device as shown in FIG. 11. The conditions for preparation of the respective layer regions constituting the amorphous layer (I) and the amorphous layer (II) are shown in Table 19 below.

Distribution concentration of oxygen $C_{(O)1}$: 2 atomic %
Distribution concentration of boron $C_{(III)1}$: 200 atomic ppm
Distribution concentration of boron $C_{(III)3}$: 5 atomic %

Using the image forming member for electrophotography obtained, toner images were formed repeatedly on transfer papers by applying electrophotographic process similarly as in Example 12, whereby toner transferred images of high quality could be obtained stably.

EXAMPLE 20

An image forming member for electrophotography having an amorphous layer (I) having the layer constitution as shown in FIG. 9 on an aluminum substrate was formed by means of the preparation device as shown in FIG. 11. The conditions for preparation of the respective layer regions constituting the amorphous layer (I) and the amorphous layer (II) are shown in Table 20 below.

Distribution concentration of oxygen $C_{(O)1}$: 5 atomic %
Distribution concentration of oxygen $C_{(O)3}$: 2 atomic %
Disbribution concentration of boron $C_{(III)1}$: 50 atomic ppm Using the image forming member for electrophotography obtained, toner images were formed repeatedly on transfer papers by applying electrophotographic process similarly as in Example 12, whereby toner transferred images of high quality could be obtained stably.

TABLE 19

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4$/He = 0.5<br>NO 100<br>$B_2H_6$/He = $3 \times 10^{-3}$ | $SiH_4$ = 200 | NO/$SiH_4$ = $2.2 \times 10^{-2}$<br>$B_2H_6$/$SiH_4$ = $2 \times 10^{-4}$ | 20 | 20 |
| Second layer region ($t_2t_3$) | $SiH_4$/He = 0.5<br>NO 100<br>$B_2H_6$/He = $3 \times 10^{-3}$ | $SiH_4$ = 200 | NO/$SiH_4$ = $2.2 \times 10^{-2}$ ~ $1.47 \times 10^{-2}$<br>$B_2H_6$/$SiH_4$ = $2 \times 10^{-4}$~$5 \times 10^{-6}$ | 20 | 0.3 |
| Third layer region ($t_1t_2$) | $SiH_4$/He = 0.5<br>NO 100<br>$B_2H_6$/He = $3 \times 10^{-3}$ | $SiH_4$ = 200 | NO/$SiH_4$ = $1.47 \times 10^{-2}$~0<br>$B_2H_6$/$SiH_4$ = $5 \times 10^{-6}$ | 20 | 1.0 |
| Fourth layer region ($t_5t_1$) | $SiH_4$/He = 0.5<br>$B_2H_6$/He = $3 \times 10^{-3}$ | $SiH_4$ = 200 | $B_2H_6$/$SiH_4$ = $5 \times 10^{-6}$ | 20 | 2.0 |
| Amorphous layer (II) | $SiH_4$/He = 0.5<br>$C_2H_4$ | $SiH_4$ = 100 | $SiH_4$:$C_2H_4$ = 5:5 | 6 | 3 |

Substrate temperature: 250° C.
Discharging frequency: 13.56 MHz
Inner pressure in reaction chamber: 0.5 Torr
Discharging power: 0.2 W/cm$^2$

TABLE 20

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region | $SiH_4$/He = 0.5<br>NO 100<br>$B_2H_6$/He = $3 \times 10^{-3}$ | $SiH_4$ = 200 | NO/$SiH_4$ = 1.1 × 10−2<br>$B_2H_6$/$SiH_4$ = $4 \times 10^{-5}$ | 20 | 20 |

TABLE 20-continued

| Layer constitution | Gases employed (Vol %) | Flow rate (SCCM) | Flow rate ratio | Layer formation speed (Å/S) | Layer thickness (μ) |
|---|---|---|---|---|---|
| ($t_2t_B$) | | | | | |
| Second layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.1 \times 10^{-2}$<br>$\sim 4.4 \times 10^{-3}$<br>$B_2H_6/SiH_4 = 4 \times 10^{-4}$ | 20 | 0.5 |
| Third layer region ($t_st_1$) | $SiH_4/He = 0.5$ | $SiH_4 = 300$ | | 20 | 1 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Inner pressure in reaction chamber: 0.5 Torr
Discharging power: 0.2 W/cm$^2$
Discharging frequency: 13.56 MHz

EXAMPLE 21

An image forming member for electrophotography having an amorphous layer (I) having the layer constitution as shown in FIG. 2 on an aluminum substrate was formed by means of the preparation device as shown in FIG. 11. The conditions for preparation of the respective layer gegions constituting the amorphous layer (I) and the amorphous layer (II) are shown in Table 21 below.

Distribution concentration of oxygen $C_{(O)1}$: 3.5 atomic %

Distribution concentration of boron $C_{(III)1}$: 80 atomic ppm

Distribution concentration of boron $C_{(III)3}$: 500 atomic ppm

Using the image forming member for electrophotography obtained, toner images were formed repeatedly on transfer papers by applying electrophotographic process similarly as in Example 12, whereby toner transferred images of high quality could be obtained stably.

TABLE 21

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_4t_B$) | $SiH_4/He = 0.5$<br>NO 100<br>$B_2H_6/He = 3.3 \times 10^{-3}$ | $SiH_4 = 200$ | $NO/SiH_4 = 4 \times 10^{-2}$<br>$B_2H_6/SiH_4 = 5 \times 10^{-4}$ | 20 | 0.3 |
| Second layer region ($t_2t_4$) | $SiH_4/He = 0.5$<br>NO 100<br>$B_2H_6/He = 3.3 \times 10^{-3}$ | $SiH_4 = 200$ | $NO/SiH_4 = 4 \times 10^{-2}$<br>$B_2H_6/SiH_4 = 8 \times 10^{-5}$ | 20 | 20 |
| Third layer region ($t_1t_2$) | $SiH_4/He = 0.5$<br>NO 100<br>$B_2H_6/He = 3.3 \times 10^{-3}$ | $SiH_4 = 200$ | $NO/SiH_4 = 4 \times 10^{-2} \sim 0$<br>$B_2H_6/SiH_4 = 8 \times 10^{-5} \sim 0$ | 20 | 1 |
| Forth layer region ($t_st_1$) | $SiH_4/He = 0.5$ | $SiH_4 = 300$ | | 20 | 0.15 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging frequency: 13.56 MHz
Discharging power: 0.2 W/cm$^2$
Inner pressure in reaction chamber: 0.5 Torr

EXAMPLE 22

An image forming member for electrophotography having an amorphous layer (I) having the layer constitution as shown in FIG. 3 on an aluminum substrate was formed by means of the preparation device as shown in FIG. 11. The conditions for preparation of the respective layer regions constituting the amorphous layer (I) and the amorphous layer (II) are shown in Table 22 below.

Distribution concentration of oxygen $C_{(O)1}$: 3.5 atomic %

Distribution concentration of boron $C_{(III)1}$: 80 atomic ppm

Using the image forming member for electrophotography obtained, toner images were formed repeatedly on transfer papers by applying electrophotographic process similarly as in Example 12, whereby toner transferred images of high quality could be obtained stably.

TABLE 22

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 4 \times 10^{-2}$<br>$SiF_4/SiH_4 = 0.2$<br>$B_2H_6/(SiH_4 + SiF_4) = 8 \times 10^{-5}$ | 20 | 20 |
| Second layer region ($t_2t_3$) | $SiH_4/He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 4 \times 10^{-2} \sim 2 \times 10^{-2}$<br>$SiF_4/SiH_4 = 0.2$<br>$B_2H_6/(SiH_4 + SiF_4) = 8 \times 10^{-5}$ | 20 | 0.5 |
| Third layer region ($t_1t_2$) | $SiH_4/He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 2 \times 10^{-2} \sim 0$<br>$SiF_4/SiH_4 = 0.2$<br>$B_2H_6/(SiH_4 + SiF_4) = 8 \times 10^{-5} \sim 0$ | 20 | 0.5 |
| Fourth layer region ($t_5t_1$) | $SiH_4/He = 0.5$<br>$SiF_4/He = 0.5$ | $SiH_4 = 300$ | $SiF_4/SiH_4 = 0.2$. | 20 | 1 |
| Amorphous layer (II) | $SiH_4/He = 0.5$<br>$C_2H_4$ | $SiH_4 = 100$ | $SiH_4:C_2H_4 = 5:5$ | 6 | 3 |

Substrate temperature: 250° C.
Discharging frequency: 13.56 MHz
Discharging power: 0.18 W/cm$^2$
Inner pressure in reaction chamber: 0.5 Torr

EXAMPLE 23

An image forming member for electrophotography having an amorphous layer (I) having the layer constitution as shown in FIG. 3 on an aluminum substrate was formed by means of the preparation device as shown in FIG. 11. The conditions for preparation of the respective layer regions constituting the amorphous layer (I) and the amorphous layer (II) are shown in Table 23 below.

Distribution concentration of oxygen $C_{(O)1}$: 3.5 atomic %

Distribution concentration of boron $C_{(III)1}$: 80 atomic ppm

The image forming member prepared was evaluated comprehensively by superiority or inferiority of density, resolution and halftone reproducibility of the image visualized on a transfer paper after a series of electrophotographic process of charging-imagewise exposure-development-transfer.

TABLE 23

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 4 \times 10^{-2}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 4 \times 10^{-2} \sim 2 \times 10^{-2}$<br>$B_2H_6/SiH_4 = 8 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 2 \times 10^{-2} \sim 0$<br>$B_2H_6/SiH_4 = 8 \times 10^{-5} \sim 0$ | 20 | 0.5 |
| Fourth layer region ($t_5t_1$) | $SiH_4/He = 0.5$ | $SiH_4 = 300$ | | 20 | 1 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 4:2:4$ | 8 | 2 |

Substrate temperature: 250° C.
Inner pressure in reaction chamber: 0.5 Torr
Discharging frequency: 13.56 MHz
Discharging power 0.18 W/cm$^2$

EXAMPLE 24

Image forming members were prepared according to entirely the same method as in Example 23 except that the content ratio of silicon atoms to carbon atoms was varied in the amorphous layer (II) by varying the flow rate ratio of ($SiH_4+SiF_4$) gas to $C_2H_4$ gas during formation of the amorphous layer (II). The results obtained are shown in Table 24.

TABLE 24

| | | | | | |
|---|---|---|---|---|---|
| Si:C (Content ratio) | 9.7:0.3 | 8.8:1.2 | 7.3:2.7 | 4.7:5.3 | 3.1:6.9 |
| Image | | | | | Δ |

TABLE 24-continued

| quality evaluation |
|---|
| o: very good |
| Δ: Image defect slightly formed |

EXAMPLE 25

Image forming members were prepared according to entirely the same method as in Example 23 except for varying the layer thickness of the amorphous layer (II). By carrying out repeatedly the steps of image formation, development and cleaning, the following results were obtained.

TABLE 14

| Thickness of amorphous layer (II) (μ) | Results |
|---|---|
| 0.001 | Image defect liable to form |
| 0.02 | No image defect formed during 20,000 repetitions |
| 0.05 | Stable for 20,000 or more repetitions |
| 1 | Stable for 100,000 or more repetitions |

EXAMPLE 26

An image forming member for electrophotography having an amorphous layer (I) having the layer constitution as shown in FIG. 4 on an aluminum substrate was formed by means of the preparation device as shown in FIG. 11. The conditions for preparation of the respective layer regions constituting the amorphous layer (I) and the amorphous layer (II) are shown in Table 26 below.

Distribution concentration of oxygen $C_{(O)1}$: 7 atomic %

Distribution concentration of boron $C_{(III)1}$: 30 atomic ppm

Using the image forming member for electrophotography obtained, toner images were formed repeatedly on transfer papers by applying electrophotographic process similarly as in Example 23, whereby toner transferred images of high quality could be obtained stably.

TABLE 26

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 3 \times 10^{-5}$ | 20 | 20 |
| Second layer region ($t_2t_3$) | $SiH_4/He = 0.5$<br>NO 100<br>$B_2H_6/He = 3 \times 10 -3$ | $SiH_4 = 200$ | $NO/SiH_4 = 8 \times 10^{-2}$<br>$B_2H_6/SiH_4 = 3.0 \times 10^{-4}$<br>$\sim 1.5 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 0$<br>$B_2H_6/SiH_4 = 1.5 \times 10^{-5} \sim 0$ | 20 | 0.5 |
| Fourth layer region $t_St_1$) | $SiH_4/He = 0.5$ | $SiH_4 = 300$ | | 20 | 1 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 7 | 2 |

Substrate temperature: 250° C.
Discharging frequency: 13.56 MHz
Inner pressure in reaction chamber: 0.5 Torr
Discharging power: 0.2 W/cm$^2$

EXAMPLE 27

An image forming member for electrophotography having an amorphous layer (I) having the layer constitution as shown in FIG. 5 on an aluminum substrate was formed by means of the preparation device as shown in FIG. 11. The conditions for preparation of the respective layer regions constituting the amorphous layer (I) and the amorphous layer (II) are shown in Table 27 below.

Distribution concentration of oxygen $C_{(O)1}$: 7 atomic %

Distribution concentration of boron $C_{(III)1}$: 10 atomic ppm

Distribution concentration of boron $C_{(III)3}$: 5 atomic %

Using the image forming member for electrophotography obtained, toner images were formed repeatedly on transfer papers by applying electrophotographic process similarly as in Example 23, whereby toner transferred images of high quality could be obtained stably.

TABLE 27

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region | $SiH_4/He = 0.5$<br>NO 100<br>$B_2H_6/He = 3 \times 10^{-3}$ | $SiH_4 = 200$ | $NO/SiH_4 = 8 \times 10^{-2}$<br>$B_2H_6/SiH_4 = 1 \times 10^{-5}$ | 18 | 20 |

TABLE 27-continued

| Layer constitution | Gases employed (Vol %) | Flow rate (SCCM) | Flow rate ratio | Layer formation speed (Å/S) | Layer thickness (μ) |
|---|---|---|---|---|---|
| ($t_5t_B$) | | | | | |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 8 \times 10^{-2} \sim 5 \times 10^{-2}$<br>$B_2H_6/SiH_4 = 1 \times 10^{-5}$ | 18 | 0.5 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 5 \times 10^{-2} \sim 0$<br>$B_2H_6/SiH_4 = 1 \times 10^{-5} \sim 5 \times 10^{-5}$ | 18 | 0.3 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 5 \times 10^{-6}$ | 18 | 0.5 |
| Fifth layer region ($t_1t_2$) | $SiH_4/He = 0.5$<br>NO 100<br>$B_2H_6/He = 3 \times 10^{-3}$ | $SiH_4 = 200$ | $B_2H_6/SiH_4 = 5 \times 10^{-6} \sim 0$ | 18 | 0.3 |
| Sixth layer region ($t_5t_1$) | $SiH_4/He = 0.5$ | $SiH_4 = 300$ | | 18 | 0.3 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:2:5$ | 8 | 2 |

Substrate temperature: 250° C.
Discharging frequency: 13.56 MHz
Discharging power: 0.18 W/cm$^2$
Inner pressure in reaction chamber: 0.5 Torr

EXAMPLE 28

An image forming member for electrophotography having an amorphous layer (I) having the layer constitution as shown in FIG. 6 on an aluminum substrate was formed by means of the preparation device as shown in FIG. 11. The conditions for preparation of the respective layer regions constituting the amorphous layer (I) and the amorphous layer (II) are shown in Table 28 below.

Distribution concentration of oxygen $C_{(O)1}$: 1 atomic %
Distribution concentration of boron $C_{(III)1}$: 100 atomic ppm
Distribution concentration of boron $C_{(III)3}$: 10 atomic %

Using the image forming member for electrophotography obtained, toner images were formed repeatedly on transfer papers by applying electrophotographic process similarly as in Example 23, whereby toner transferred images of high quality could be obtained stably.

TABLE 28

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_5t_B$) | $SiH_4/He = 0.5$<br>NO 100<br>$B_2H_6/He = 3 \times 10^{-3}$ | $SiH_4 = 200$ | $NO/SiH_4 = 1.1 \times 10^{-3}$<br>$B_2H_6/SiH_4 = 8 \times 10^{-5}$ | 20 | 20 |
| Second layer region ($t_4t_5$) | $SiH_4/He = 0.5$<br>NO 100<br>$B_2H_6/He = 3 \times 10^{-3}$ | $SiH_4 = 200$ | $NO/SiH_4 = 1.1 \times 10^{-2} \sim 7.4 \times 10^{-3}$<br>$B_2H_6/SiH_4 = 8.0 \times 10^{-5} \sim 1 \times 10^{-5}$ | 20 | 1.0 |
| Third layer region ($t_3t_4$) | $SiH_4/He = 0.5$<br>NO 100<br>$B_2H_6/He = 3 \times 10^{-3}$ | $SiH_4 = 200$ | $NO/SiH_4 = 7.4 \times 10^{-3} \sim 0$<br>$B_2H_6/SiH_4 = 1 \times 10^{-5}$ | 20 | 0.5 |
| Fourth layer region ($t_2t_3$) | $SiH_4/He = 0.5$<br>$B_2H_6/He = 3 \times 10^{-3}$ | $SiH_4 = 200$ | $B_2H_6/SiH_4 = 1 \times 10^{-5}$ | 20 | 0.3 |
| Fifth layer region ($t_1t_2$) | $SiH_4/He = 0.5$<br>$B_2H_6/He = 3 \times 10^{-3}$ | $SiH_4 = 200$ | $B_2H_6/SiH_4 = 1 \times 10^{-5} \sim 0$ | 20 | 0.5 |
| Sixth layer region ($t_5T_1$) | $SiH_4/He = 0.5$ | $SiH_4 = 300$ | | 20 | 0.5 |
| Amorphous layer II) | $SiH_4/He = 0.5$<br>$SiF_4/He = 0.5$ | $SiH_4 + SiF_4 = 150$ | $SiH_4:SiF_4:C_2H_4 = 4:2:4$ | 8 | 2 |

TABLE 28-continued

| Layer constitution | Gases employed (Vol %) | Flow rate (SCCM) | Flow rate ratio | Layer formation speed (Å/S) | Layer thickness (μ) |
|---|---|---|---|---|---|
| | $C_2H_4$ | | | | |

Substrate temperature: 250° C.
Discharging power: 0.18 W/cm$^2$
Discharging frequency: 13.56 MHz
Inner pressure in reaction chamber: 0.5 Torr

EXAMPLE 29

An image forming member for electrophotography having an amorphous layer (I) having the layer constitution as shown in FIG. 7 on an aluminum substrate was formed by means of the preparation device as shown in FIG. 11. The conditions for preparation of the respective layer regions constituting the amorphous layer (I) and the amorphous layer (II) are shown in Table 29 below.

Distribution concentration of oxygen $C_{(O)1}$: 2 atomic %
Distribution concentration of boron $C_{(III)1}$: 30 atomic ppm
Distribution concentration of boron $C_{(III)3}$: 5 atomic %

Using the image forming member for electrophotography obtained, toner images were formed repeatedly on transfer papers by applying electrophotographic process similarly as in Example 23, whereby toner transferred images of high quality could be obtained stably.

EXAMPLE 30

An image forming member for electrophotography having an amorphous layer (I) having the layer constitution as shown in FIG. 8 on an aluminum substrate was formed by means of the preparation device as shown in FIG. 11. The conditions for preparation of the respective layer regions constituting the amorphous layer (I) and the amorphous layer (II) are shown in Table 30 below.

Distribution concentration of oxygen $C_{(O)1}$: 2 atomic %
Distribution concentration of boron $C_{(III)1}$: 200 atomic ppm
Distribution concentration of boron $C_{(III)3}$: 5 atomic %

Using the image forming member for electrophotography obtained, toner images were formed repeatedly on transfer papers by applying electrophotographic process similarly as in Example 23, whereby toner transferred images of high quality could be obtained stably.

TABLE 29

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$B_2H_6SiH_4 = 3 \times 10^{-5}$ | 20 | 20 |
| Second layer region ($t_2t_3$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$\sim 1.38 \times 10^{-2}$<br>$B_2H_6/SiH_4 = 3.0 \times 10^{-5}$ | 20 | 0.5 |
| Third layer region ($t_1t_2$) | $SiH_4/He = 0.5$<br>NO 100<br>$B_2H_6/He = 3 \times 10^{-3}$ | $SiH_4 = 200$ | $NO/SiH_4 = 1.38 \times 10^{-2} \sim 0$<br>$B_2H_6/SiH_4 = 3 \times 10^{-5} \sim 5 \times 10^{-6}$ | 20 | 0.3 |
| Fourth layer region ($t_5t_1$) | $SiH_4/He = 0.5$<br>$B_2H_6/He = 3 \times 10^{-3}$ | $SiH_4 = 200$ | $B_2H_6/SiH_4 = 5 \times 10^{-6}$ | 20 | 0.2 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 7 | 2 |

Substrate temperature: 250° C.
Discharging frequency: 13.56 MHz
Inner pressure in reaction chamber: 0.5 Torr
Discharging power: 0.2 W/cm$^2$

TABLE 30

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4/He = 0.5$<br>NO 100<br>$B_2H_6/He = 3 \times 10^{-3}$ | $SiH_4 = 200$ | $NO/SiH_4 = 2.2 \times 10^{-2}$<br>$B_2H_6/SiH_4 = 2 \times 10^{-4}$ | 20 | 20 |
| Second layer | $SiH_4/He = 0.5$<br>NO 100 | $SiH_4 = 200$ | $NO/SiH_4 = 2.2 \times 10^{-2}$<br>$\sim 1.47 \times 10^{-2}$ | 20 | 0.3 |

TABLE 30-continued

| Layer constitution | Gases employed (Vol %) | Flow rate (SCCM) | Flow rate ratio | Layer formation speed (Å/S) | Layer thickness (μ) |
|---|---|---|---|---|---|
| region ($t_2t_3$) | $B_2H_6/He = 3 \times 10^{-3}$ | | $B_2H_6/SiH_4 = 2.0 \times 10^{-4} \sim 5 \times 10^{-6}$ | | |
| Third layer region ($t_1t_2$) | $SiH_4/He = 0.5$ NO 100 $B_2H_6/He = 3 \times 10^{-3}$ | $SiH_4 = 200$ | $NO/SiH_4 = 1.47 \times 10^{-2} \sim 0$ $B_2H_6/SiH_4 = 5 \times 10^{-6}$ | 20 | 1.0 |
| Fourth layer region ($t_5t_1$) | $SiH_4/He = 0.5$ $B_2H_6/He = 3 \times 10^{-3}$ | $SiH_4 = 200$ | $B_2H_6/SiH_4 = 5 \times 10^{-6}$ | 20 | 2.0 |
| Amorphous layer (II) | $SiH_4/He = 0.5$ $SiF_4/He = 0.5$ $C_2H_4$ | $SiH_4 + SiF_4 = 150$ | $SiH_4:SiF_4:C_2H_4 = 3:2:5$ | 8 | 2 |

Substrate temperature: 250° C.
Discharging frequency: 13.56 MHz
Inner pressure in reaction chamber: 0.5 Torr
Discharging power: 0.2 W/cm$^2$

EXAMPLE 31

An image forming member for electrophotography having an amorphous layer (I) having the layer constitution as shown in FIG. 9 on an aluminum substrate was formed by means of the preparation device as shown in FIG. 11. The conditions for preparation of the respective layer regions constituting the amorphous layer (I) and the amorphous layer (II) are shown in Table 31 below.

Distribution concentration of oxygen $C_{(O)1}$: 5 atomic %
Distribution concentration of oxygen $C_{(O)3}$: 2 atomic %
Distribution concentration of boron $C_{(III)1}$: 50 atomic ppm Using the image forming member for electrophotography obtained, toner images were formed repeatedly on transfer papers by applying electrophotographic process similarly as in Example 23, whereby toner transferred images of high quality could be obtained stably.

EXAMPLE 32

An image forming member for electrophotography having an amorphous layer (I) having the layer constitution as shown in FIG. 2 on an aluminum substrate was formed by means of the preparation device as shown in FIG. 11. The conditions for preparation of the respective layer regions constituting the amorphous layer (I) and the amorphous layer (II) are shown in Table 32 below.

Distribution concentration of oxygen $C_{(O)1}$: 3.5 atomic %
Distribution concentration of boron $C_{(III)1}$: 80 atomic ppm
Distribution concentration of boron $C_{(III)3}$: 500 atomic ppm Using the image forming member for electrophotography obtained, toner images were formed repeatedly on transfer papers by applying electrophotographic process similarly as in Example 23, whereby toner transferred images of high quality could be obtained stably.

TABLE 31

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_2t_B$) | $SiH_4/He = 0.5$ NO 100 $B_2H_6/He = 3 \times 10^{-3}$ | $SiH_4 = 200$ | $NO/SiH_4 = 1.1 \times 10^{-2}$ $B_2H_6/SiH_4 = 4 \times 10^{-5}$ | 20 | 20 |
| Second layer region ($t_1t_2$) | $SiH_4/He = 0.5$ NO 100 $B_2H_6/He = 3 \times 10^{-3}$ | $SiH_4 = 200$ | $No/SiH_4 = 1.1 \times 10^{-2} \sim 4.4 \times 10^{-3}$ $B_2H_6/SiH_4 = 4 \times 10^{-4}$ | 20 | 20 |
| Third layer region ($t_5t_1$) | $SiH_4/He = 0.5$ | $SiH_4 = 300$ | | 20 | 1 |
| Amorphous layer (II) | $SiH_4/He = 0.5$ $SiF_4/He = 0.5$ $C_2H_4$ | $SiH_4 + SiF_4 = 150$ | $SiH_4:SiF_4:C_2H_4 = 4:2:4$ | 8 | 2 |

Substrate temperature: 250° C.
Discharging power: 0.2 W/cm$^2$
Discharging frequency: 13.56 MHz
Inner pressure in reaction chamber: 0.5 Torr

TABLE 32

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_4t_B$) | $SiH_4/He = 0.5$<br>NO 100<br>$B_2H_6/He = 3.3 \times 10^{-3}$ | $SiH_4 = 200$ | $NO/SiH_4 = 4 \times 10^{-2}$<br>$B_2H_6/SiH_4 = 5 \times 10^{-4}$ | 20 | 0.3 |
| Second layer region ($t_2t_4$) | $SiH_4/He = 0.5$<br>NO 100<br>$B_2H_6/He = 3.3 \times 10^{-3}$ | $SiH_4 = 200$ | $NO/SiH_4 = 4 \times 10^{-2}$<br>$B_2H_6/SiH_4 = 8 \times 10^{-5}$ | 20 | 20 |
| Third layer region ($t_1t_2$) | $SiH_4/He = 0.5$<br>NO 100<br>$B_2H_6/He = 3.3 \times 10^{-3}$ | $SiH_4 = 200$ | $NO/SiH_4 = 4 \times 10^{-2} \sim 0$<br>$B_2H_6/SiH_4 = 8 \times 10^{-5} \sim 0$ | 20 | 1 |
| Fourth layer region ($t_5t_1$) | $SiH_4/He = 0.5$ | $SiH_4 = 300$ | | 20 | 0.15 |
| Amorphous layer (II) | $SiH_4/He = 0.5$<br>$SiF_4/He = 0.5$<br>$C_2H_4$ | $SiH_4 = 100$ | $SiH_4:SiF_4:C_2H_4 = 3:3:4$ | 7 | 2 |

Substrate temperature: 250° C.
Discharging frequency: 13.56 MHz
Discharging power: 0.2 W/cm$^2$
Inner pressure in reaction chamber: 0.5 Torr

EXAMPLE 33

An image forming member for electrophotography having an amorphous layer (I) having the layer constitution as shown in FIG. 3 on an aluminum substrate was formed by means of the preparation device as shown in FIG. 11. The conditions for preparation of the respective layer regions constituting the amorphous layer (I) and the amorphous layer (II) are shown in Table 33 below.

Distribution concentration of oxygen $C_{(O)1}$: 3.5 atomic %

Distribution concentration of boron $C_{(III)1}$: 80 atomic ppm

Using the image forming member for electrophotography obtained, toner images were formed repeatedly on transfer papers by applying electrophotographic process similarly as in Example 23, whereby toner transferred images of high quality could be obtained stably.

TABLE 33

| Layer constitution | Gases employed (Vol %) | Flow rate (SCCM) | Flow rate ratio | Layer formation speed (Å/S) | Layer thickness (μ) |
|---|---|---|---|---|---|
| Amorphous layer (I) | | | | | |
| First layer region ($t_3t_B$) | $SiH_4He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 4 \times 10^{-2}$<br>$SiF_4/SiH_4 = 0.2$<br>$B_2H_6/(SiH_4 + SiF) = 8 \times 10^{-5}$ | 20 | 20 |
| Second layer region ($t_2t_3$) | $SiH_4/He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 4 \times 10^{-2}$<br>$\sim 2 \times 10^{-2}$<br>$SiF_4/SiH_4 = 0.2$<br>$B_2H_6/(SiH_4 + SiF_4) = 8 \times 10^{-5}$ | 20 | 0.5 |
| Third layer region ($t_1t_2$) | $SiH_4/He = 0.5$<br>$SiF_4/He = 0.5$<br>NO 100<br>$B_2H_6/He = 3 \times 10^{-3}$ | $SiH_4 = 200$ | $NO/(SiH_4 + SiF_4) = 2 \times 10^{-2} \sim 0$<br>$SiF_4/SiH_4 = 0.2$<br>$B_2H_6/(SiH_4 + SiF_4) = 8 \times 10^{-5} \sim 0$ | 20 | 0.5 |
| Fourth layer region ($t_5t_1$) | $SiH_4/He = 0.5$<br>$SiF_4/He = 0.5$ | $SiH_4 = 300$ | $SiF_4/SiH_4 = 0.2$ | 20 | 1 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:2:5$ | 8 | 2 |

Substrate temperature: 250° C.
Discharging power: 0.18 W/cm$^2$
Discharging frequency: 13.56 MHz
Inner pressure in reaction chamber: 0.5 Torr

What we claim is:

1. A photoconductive member comprising:

a support for a photoconductive member;

a first amorphous layer comprising an amorphous material containing silicon atoms as a matrix and exhibiting photoconductivity, said first amorphous layer having a first layer region containing oxygen atoms as constituent atoms in a distribution state which is uniform and continuous in the direction of layer thickness and a second layer region containing atoms belonging to the group III of the periodic table as constituent atoms in a distribution state which is continuous in the direction of layer thickness, said first layer region existing internally beneath the surface of said first amorphous layer, wherein the first layer region and the second layer region share at least a portion thereof; and a second amorphous layer comprising an amorphous material represented by any of the following formulae:

$$Si_aC_{1-a}(0.4<a<1) \quad (1)$$

$$(Si_bC_{1-b})_cH_{1-c}(0.5<b<1,\ 0.6\leqq c<1) \quad (2)$$

$$(Si_dC_{1-d})_eX_{1-e}(0.47<d<1,\ 0.8\leqq e<1) \quad (3)$$

$$(Si_fC_{1-f})_g(H+X)_{1-g}(0.47<f<1,\ 0.8\leqq g<1) \quad (4)$$

wherein X represents a halogen atom.

2. A photoconductive member according to claim 1, wherein the state of distribution of the atoms belonging to the group III of the periodic table is uniform in the direction of the layer thickness of the second layer region.

3. A photoconductive member according to claim 1, wherein the state of distribution of the atoms belonging to the group III of the periodic table is ununiform in the direction of the layer thickness of the second layer region.

4. A photoconductive member according to claim 1, wherein the first layer region and the second layer region are substantially the same region.

5. A photoconductive member according to claim 1, wherein the first layer region constitutes a part of the second layer region.

6. A photoconductive member according to claim 1, wherein the second layer region constitutes a part of the first layer region.

7. A photoconductive member according to claim 1, wherein hydrogen atoms are contained in the first amorphous layer.

8. A photoconductive member according to claim 7, wherein the content of hydrogen atoms in the first amorphous layer is 1 to 40 atomic %.

9. A photoconductive member according to claim 1, wherein halogen atoms are contained in the first amorphous layer.

10. A photoconductive member according to claim 9, wherein the content of halogen atoms is 1 to 40 atomic %.

11. A photoconductive member according to claim 1, wherein hydrogen atoms and halogen atoms are contained in the first amorphous layer.

12. A photoconductive member according to claim 11, wherein the total content of hydrogen atoms and halogen atoms is 1 to 40 atomic %.

13. A photoconductive member according to claim 1, wherein the atoms belonging to the group III of the periodic table are selected from B, Al, Ga, In and Tl.

14. A photoconductive member according to claim 1, wherein the content of the atoms belonging to the group III of the periodic table in the second layer region is 0.01 to 1000 atomic ppm.

15. A photoconductive member according to claim 1, wherein said second layer region has a layer region (Z) containing the atoms belonging to the group III of the periodic table at a high concentration on the side of the support.

16. A photoconductive member according to claim 15, wherein the content of the atoms belonging to the group III of the periodic table in the layer region (Z) is 0.1–10,000 atomic ppm.

17. A photoconductive member according to claim 1, wherein said first layer region has a layer region (O) containing oxygen atoms at a high concentration of the side of the support.

18. A photoconductive member according to claim 17, wherein the content of the oxygen atoms in the layer region (O) is 0.01–30 atomic %.

19. A photoconductive member according to claim 1, wherein said first amorphous layer has a layer region containing no oxygen atom between the first layer region and the second amorphous layer.

20. A photoconductive member according to claim 19, wherein said layer region containing no oxygen atom has a layer thickness of 100A–10 microns.

21. A photoconductive member according to claim 1, wherein said first amorphous layer has a layer thickness of 1–100 microns.

22. A photoconductive member according to claim 1, wherein said second amorphous layer has a layer thickness of 0.1–10 microns.

* * * * *

UNITED STATES PATENT AND TRADEMARK OFFICE

CERTIFICATE OF CORRECTION

PATENT NO. : 4,547,448

DATED : October 15, 1985

INVENTOR(S) : SHIGERU SHIRAI ET AL.

It is certified that error appears in the above-identified patent and that said Letters Patent is hereby corrected as shown below:

Claim 1, line 8, change "uniform" to --ununiform--.

Signed and Sealed this

Second Day of December, 1986

*Attest:*

DONALD J. QUIGG

*Attesting Officer*

*Commissioner of Patents and Trademarks*